US011688525B2

(12) United States Patent
Tokonami

(10) Patent No.: US 11,688,525 B2
(45) Date of Patent: Jun. 27, 2023

(54) RADIOACTIVE FINE PARTICLE MANUFACTURING SYSTEM AND METHOD

(71) Applicant: HIROSAKI UNIVERSITY, Aomori (JP)

(72) Inventor: Shinji Tokonami, Aomori (JP)

(73) Assignee: HIROSAKI UNIVERSITY, Aomori (JP)

( * ) Notice: Subject to any disclaimer, the term of this patent is extended or adjusted under 35 U.S.C. 154(b) by 712 days.

(21) Appl. No.: 16/496,137

(22) PCT Filed: Mar. 9, 2018

(86) PCT No.: PCT/JP2018/009285
§ 371 (c)(1),
(2) Date: Sep. 20, 2019

(87) PCT Pub. No.: WO2018/173811
PCT Pub. Date: Sep. 27, 2018

(65) Prior Publication Data

US 2020/0043622 A1 Feb. 6, 2020

(30) Foreign Application Priority Data

Mar. 23, 2017 (JP) ..... 2017-058121

(51) Int. Cl.
*G21G 4/10* (2006.01)
*G21G 4/06* (2006.01)
*G21G 1/00* (2006.01)

(52) U.S. Cl.
CPC ..... *G21G 4/10* (2013.01); *G21G 1/0005* (2013.01); *G21G 4/06* (2013.01)

(58) Field of Classification Search
CPC ..... G21G 1/0005; G21G 4/06; G21G 4/08; G21G 4/10
See application file for complete search history.

(56) References Cited

U.S. PATENT DOCUMENTS 5,834,628 A * 11/1998 Hunter ..... G01T 7/04 250/255
2005/0155910 A1* 7/2005 Shimura ..... G01N 15/0272 209/1

FOREIGN PATENT DOCUMENTS

CN 201207026 Y * 3/2009
CN 102680999 A * 9/2012
(Continued)

OTHER PUBLICATIONS

Keng-Wu Tu, International Intercalibration and Intercomparison Measurements of Radon Progeny Particle Size Distribution, Environmental Measurements Laboratory 589 (Year: 1997).*
(Continued)

*Primary Examiner* — David L Singer
(74) *Attorney, Agent, or Firm* — Miles & Stockbridge PC

(57) ABSTRACT

A radioactive fine particle manufacturing system and method to manufacture physically stable radioactive fine particles, and which enables performance evaluation of a radioactivity measuring instrument employing a physical indicator, by controlling radioactivity concentration, and facilitating performance evaluation of the overall radioactivity measuring instrument. The radioactive fine particle manufacturing system includes a radioactive gas generating system, a specific particle-sized aerosol generating system and a mixing chamber, to manufacture radioactive fine particles employing natural radioactive nuclides, and uses. $^{220}$Rn to manufacture radioactive fine particles using physically stable progeny nuclides. In the mixing chamber, the progeny nuclides are caused to attach only to an aerosol having a specific particle size, to generate radioactive fine particles having a specific particle size.

12 Claims, 14 Drawing Sheets

(56) References Cited

FOREIGN PATENT DOCUMENTS

| | | | | | |
|---|---|---|---|---|---|
| CN | 105549065 | A | * | 5/2016 | ..... G01T 7/005 |
| CN | 206518993 | U | * | 9/2017 | |
| JP | H0549970 | A | * | 3/1993 | |
| JP | 2001165824 | A | * | 6/2001 | |
| JP | 2005003484 | A | * | 1/2005 | |
| JP | 2010-38802 | A | | 2/2010 | |
| SU | 1599716 | A1 | * | 10/1990 | |

OTHER PUBLICATIONS

Sorimachi et al, Development of an aerosol chamber for calibration of 220Rn progeny detectors, AIP Publishing LLC., Rev. Sci. Instrum. 85, 095104 (2014) (Year: 2014).*

Monsanglant-Louvet et al, Performance Assessment on Continuous Air Monitors Under Real Operating Conditions, IEEE Transactions on Nuclear Science, vol. 59, No. 4, Aug. 2012 (Year: 2002).*

Tavakoli et al, Determination of particle mass, effective density, mass-mobility exponent, and dynamic shape factor using an aerodynamic aerosol classifier and a differential mobility analyzer in tandem, Journal ofAerosolScience75(2014)35-42 (Year: 2014).*

Adachi et al, Facilitated Aerosol Sizing Using the Differential Mobility Analyzer, Elsevier Science Publishing Co., Inc., Aerosol Science and Technology 12:225-239 (1990) (Year: 1990).*

TSI Incorporated, Series 3080 Electrostatic Classifiers Operation and Service Manual, P/N 1933792, Revision J Mar. 2009 (Year: 2009).*

International Preliminary Report on Patentability dated Oct. 3, 2019 in corresponding Internation Application No. PCT/JP2018/009285.

Nabil M. Hassan, et al., "The Effect of Water Content on the Radon Emanation Coefficient for Some Building Materials Used in Japan", Radiation Measurements 46 (2011) pp. 232-237.

Shinji Tokonami, et al., "Intercomparison Exercise of Measurement Techniques for Radon, Radon Decay Products and Their Particle Size Distributions at NIRS", Jpn. J. Health Phys., 40 (2), (2005), pp. 183-190.

Atsuyuki Sorimachi, et al., "Generation and Control of Thoron Emanated From Lantern Mantles", Review of Scientific Instruments 80, pp. 015104-1 to 015104-4 (2009) American Institute of Physics.

Shinji Tokonami, et al., "Simple, Discriminative Measurement Technique for Radon and Thoron Concentrations With a Single Scintillation Cell", Review of Scientific Instruments, vol. 73, No. 1, Jan. 2002, American Institute of Physics, pp. 69-72.

Atsuyuki Sorimachi, et al., "An Intercomparison Done at NIRS, Japan on Continuous Monitors for Measuring 220 Rn Concentration", Applied Radiation and Isotopes 107 (2016) pp. 145-151.

* cited by examiner

RADIOACTIVE FINE PARTICLE MANUFACTURING SYSTEM AND METHOD

TECHNICAL FIELD

The present invention relates to a radioactive fine particle manufacturing system comprising a radioactive gas generating apparatus for generating a natural radioactive noble gas, a fine particle generating apparatus for generating a non-radioactive fine particle, a mixing chamber for generating a radioactive fine particle by mixing the generated natural radioactive noble gas and the non-radioactive fine particle, and an exposure chamber to which the generated radioactive fine particle is fed, and a radioactive fine particle manufacturing method.

BACKGROUND ART

Radioactive fine particles (radioactive aerosols), using $^{222}$Rn (radon) in uranium series as one decay series of a natural radioactive nuclide, can be manufactured and are widely introduced on a global basis in equipment for calibrating radioactivity measuring instruments (radon chambers) (non-patent document 1). Nevertheless, the radon chamber tends to be large-scale equipment. The calibration of chambers for monitoring a gas in connection with the control during $^{220}$Rn (thoron) gas generation in thorium decay series as another decay series is disclosed in a paper (non-patent document 2). However, since the research disclosed in the paper is limited to the calibration of chambers for monitoring a gas, there seems to be no further progress in the research, thereby failing to significantly develop a technique for manufacturing radioactive fine particles. Furthermore, radioactive decay occurs one after another in $^{222}$Rn for a period of time of 30 to 60 minutes (from $^{218}$Po (3.1 min), through $^{214}$Pb (26.8 min) to $^{214}$Bi (19.9 min), and so on) to be converted into a relatively stable long-lived nuclide ($^{210}$Pb with a half-life of approx. 22 years). Consequently, it is hard to achieve manufacturing of physically stable radioactive fine particles.

In this regard, the inventor released in 2002 a paper disclosing a relatively simple method for measuring $^{222}$Rn gas concentrations, and the method has globally been adopted (non-patent document 3). In fact, the measurement method achieved the global standard, and has come into use for calibrating commercially available radioactivity measuring instruments (non-patent document 4). Non-patent document 4 exemplifies content of implementation of the calibration experiment, using RAD7 (registered trademark) as a commercially available radioactivity measuring instrument.

It was revealed that in the technique for measuring $^{220}$Rn radioactivity concentrations, more water content in the air for feeding a gas significantly contributes to more $^{220}$Rn generated from a sample radiation source, or leads to more $^{220}$Rn emanation (non-patent document 5). However, this document fails to disclose a specific method for controlling radioactivity concentrations based on air humidity.

PRIOR ART LIST

Non-Patent Documents

Non-patent document 1: Shinji TOKONAMI, Yuu ISHIMORI, Tetsuo ISHIKAWA, Keizo YAMASAKI, Yuji YAMADA, "Intercomparison Exercise of Measurement Techniques for Radon, Radon Decay Products and Their Particle Size Distributions at NIRS", Jpn. J. Health Phys., 40(3), 183-190(2005).

Non-patent document 2: A. Sorimachi, S. Kumar Sahoo and S. Tokonami, "Generation and control of thoron emanated from lantern mantles", Rev. Sci. Instrum. 80, 015104 (2009).

Non-patent document 3: S. Tokonami, M. Yang, H. Yonehara and Y. Yamada, "Simple, discriminative measurement technique for radon and thoron concentrations with a single scintillation cell", Rev. Sci. Instrum. 73, 69(2002).

Non-patent document 4: A. Sorimachi, M. Janik, S. Tokonami, T. Ishikawa, "An intercomparison done at NIRS, Japan on continuous monitors for measuring $^{220}$Rn concentration", Applied Radiation and Isotopes, Volume 107, January 2016, Pages 145-151.

Non-patent document 5: Hassan, N. M., Ishikawa, T., Hosoda, M., Iwaoka, K., Sorimachi, A., Sahoo, S. K., Janik, M., Kranrod, C., Yonehara, Z H., Fukushi, M., Tokonami, S., "The effect of water content on the radon emanation coefficient for some building materials used in Japan", Radiation Measurements, Volume 46, Issue 2, February 2011, Pages 232-237.

SUMMARY OF THE INVENTION

Problem to be Solved by the Invention

As described above, a radon chamber for calibrating a radioactivity measuring instrument shown in non-patent document 1 is problematic in that it tends to be large-scale equipment. Also, there is another problem of little technological development for manufacturing radioactive fine particles. Additionally, the problem with the use of $^{222}$Rn is that it fails to manufacture physically stable radioactive fine particles.

Non-patent document 5 describes the relationship between air humidity and $^{220}$Rn emanation, but there is a problem that it fails to disclose a specific method for controlling radioactivity concentrations based on air humidity.

As mentioned above, the radon chamber for calibrating radioactivity measuring instruments tends to be large-scale equipment. Accordingly, performance evaluation of radioactivity measuring instruments such as radioactive dust monitors manufactured by radioactivity measuring instrument manufacturers is limited to the evaluation of the technology of each element only, there is a problem that it fails to achieve performance evaluation of the overall instrument.

Therefore, it is an object of the present invention to solve the above-described problem and to provide a radioactive fine particle manufacturing system or the like capable of manufacturing a radioactive fine particle without using large-scale equipment. Furthermore, another objective of the present invention is to provide a radioactive fine particle manufacturing system or the like capable of manufacturing a physically stable radioactive fine particle using a natural radioactive nuclide (particularly $^{220}$Rn) and achieving not only radioactivity concentrations of manufactured radioactive fine particles, but also a performance evaluation of radioactivity measuring instruments using a novel physical indicator.

A second objective of the present invention is to provide a radioactive fine particle manufacturing system or the like indicative of a specific method for controlling radioactivity concentrations based on air humidity when a radioactive fine particle is manufactured using radioactive noble gases ($^{220}Rn$, $^{222}Rn$) having a short half-life.

A third objective of the present invention is to provide a radioactive fine particle manufacturing system or the like capable of achieving performance evaluation of the overall radioactivity measuring instruments manufactured by radioactivity measuring instrument manufacturers without using large-scale equipment.

Means for Solving the Problem

A radioactive fine particle manufacturing system of the present invention is a radioactive fine particle manufacturing system, comprising: a radioactive gas generating apparatus for generating a natural radioactive noble gas, a fine particle generating apparatus for generating a non-radioactive fine particle, and a mixing chamber for mixing the natural radioactive noble gas generated by the radioactive gas generating apparatus and the non-radioactive fine particle generated by the fine particle generating apparatus, wherein the radioactive gas generating apparatus includes a radiation source unit that has a natural radiation source therein, whereby the apparatus feeds externally acquired air to the radiation source unit, mixes the air and the natural radioactive noble gas generated from the natural radiation source, and feeds the same to the mixing chamber, the fine particle generating apparatus includes a fine particle generator for generating a fine particle and a particle discriminator for discriminating a fine particle having a predetermined particle size, whereby the apparatus discriminates a non-radioactive fine particle having a predetermined particle size from the non-radioactive fine particle generated by the fine particle generator by using the particle discriminator and feeds the same to the mixing chamber, and the mixing chamber attaches a progeny nuclide converted by radioactive decay from the natural radioactive noble gas fed from the radioactive noble gas generating apparatus to the non-radioactive fine particle having a predetermined particle size fed from the fine particle generating apparatus to generate a radioactive fine particle having a predetermined particle size.

Here, in the radioactive fine particle manufacturing system of the present invention, wherein the radioactive gas generating apparatus may further comprise a humidity control unit for feeding acquired air by controlling the humidity thereof, whereby the apparatus controls the radioactivity concentration of a natural radioactive noble gas generated from the natural radiation source by feeding externally acquired air to the radiation source unit after allowing the air to pass through the humidity control unit.

Here, in the radioactive fine particle manufacturing system of the present invention, wherein the mixing chamber may further comprise a pipe for feeding a generated radioactive fine particle having a predetermined particle size to the exterior, wherein the pipe includes therein one or more externally removable filters for collecting the radioactive fine particle having a predetermined particle size aligned in series.

Here, in the radioactive fine particle manufacturing system of the present invention, wherein the filters may be a metal wire screen composed of a predetermined-size mesh.

Here, the radioactive fine particle manufacturing system of the present invention, may further comprise an exposure chamber for feeding a radioactive fine particle having a predetermined particle size generated in the mixing chamber, wherein the exposure chamber includes an externally removable filter for collecting a fed radioactive fine particle having a predetermined particle size.

Here, in the radioactive fine particle manufacturing system of the present invention, wherein the natural radiation source may be $^{220}Rn$ or $^{222}Rn$ generated from an environmental sample.

Here, in the radioactive fine particle manufacturing system of the present invention, wherein the particle discriminator may be a differential mobility analyzer.

A radioactive fine particle manufacturing method of the present invention is a radioactive fine particle manufacturing method by employing a radioactive gas generating apparatus for generating a natural radioactive noble gas, a fine particle generating apparatus for generating a non-radioactive fine particle, and a mixing chamber for mixing the natural radioactive noble gas generated by the radioactive gas generating apparatus and the non-radioactive fine particle generated by the fine particle generating apparatus, the method comprising the steps of: a generating a natural radioactive noble gas step of, in the radioactive gas generating apparatus, feeding externally acquired air to the radiation source unit including a natural radiation source therein, generating a natural radioactive noble gas from the air and the natural radiation source, and feeding the same to the mixing chamber; a generating a non-radioactive fine particle step of, in the fine particle generating apparatus, generating a non-radioactive fine particle by a fine particle generator for generating a fine particle, discriminating a non-radioactive fine particle having a predetermined particle size from the non-radioactive fine particle by using a particle discriminator for discriminating a fine particle having a predetermined particle size, and feeding the same to the mixing chamber; and a generating a radioactive fine particle step of, in the mixing chamber, attaching a progeny nuclide converted by radioactive decay from the natural radioactive noble gas fed from the radioactive gas generating apparatus in the step of generating a natural radioactive noble gas to the non-radioactive fine particle having a predetermined particle size fed from the fine particle generating apparatus in the step of generating a non-radioactive fine particle to generate a radioactive fine particle having a predetermined particle size.

Here, in the radioactive fine particle manufacturing method of the present invention, wherein the radioactive gas generating apparatus may further comprise a humidity control unit for feeding acquired air by controlling the humidity thereof, whereby the step of generating a natural radioactive noble gas controls the radioactivity concentration of the natural radioactive noble gas generated by feeding externally acquired air to the radiation source unit after allowing the air to pass through the humidity control unit.

Here, in the radioactive fine particle manufacturing method of the present invention, an exposure chamber connected to the mixing chamber may further be comprised, wherein the method may further comprise a step of collecting a radioactive fine particle for feeding a radioactive fine particle having a predetermined particle size of the mixing chamber generated in the step of generating a radioactive fine particle to the exposure chamber, and for collecting the radioactive fine particle by an externally removable filter included in the exposure chamber.

Here, in the radioactive fine particle manufacturing method of the present invention, wherein the natural radiation source may be $^{220}Rn$ or $^{222}Rn$ generated from an environmental sample.

Here, in the radioactive fine particle manufacturing method of the present invention, wherein the particle discriminator may be a differential mobility analyzer.

Effect of the Invention

The radioactive fine particle manufacturing system of the present invention a radioactive gas generating system for generating a natural radioactive noble gas, a specific particle-sized aerosol generating system for generating a non-radioactive fine particle, and a mixing chamber for mixing the natural radioactive noble gas generated by the radioactive gas generating system and the non-radioactive fine particle generated by the specific particle-sized aerosol generating system. According to the simple radioactive fine particle manufacturing system of the present invention, a radioactive fine particle using a natural radioactive nuclide can be manufactured without using large-scale equipment. A radioactive fine particle can be manufactured from a physically stable progeny nuclide converted by radioactive decay by using $^{220}$Rn as a natural radioactive nuclide in particular. Furthermore, since a progeny nuclide is attached only to an aerosol having a uniform and specific particle size (monodisperse aerosol), a radioactive fine particle having a specific particle size can be generated. Consequently, there is an effect capable of providing a radioactive fine particle manufacturing system or the like capable of achieving performance evaluation of radioactivity measuring instruments using an unprecedentedly novel physical indicator (particle size of aerosol).

The radioactive gas generating system further comprises a humidity control unit for feeding acquired air to a radiation source unit by controlling the humidity of the air. By feeding externally acquired open air through the humidity control unit to allow the air with controlled humidity to go to the radiation source unit, the radioactivity concentration of a natural radioactive noble gas generated from the natural radiation source can be controlled. Consequently, when a radioactive fine particle is manufactured using a radioactive noble gas of a short half-life ($^{220}$Rn or $^{222}$Rn), there is an effect capable of providing a radioactive fine particle manufacturing system or the like indicative of a specific method for controlling radioactivity concentrations based on air humidity.

The radioactive fine particle manufacturing system comprises an exposure chamber which is fed from the mixing chamber a radioactive fine particle having a specific (predetermined) particle size. The exposure chamber includes an externally removable filter for collecting a radioactive fine particle having a specific particle size fed from the mixing chamber. By collecting a radioactive fine particle of a radon progeny nuclide in the mixing chamber in the above filter, removing the filter from a sampling port located on the external wall of the exposure chamber, and measuring the filter by a radiation meter placed in the laboratory, the radiation meter can be calibrated. Consequently, there is an effect capable of providing a radioactive fine particle manufacturing system or the like capable of achieving performance evaluation of the overall radioactivity measuring instruments manufactured by radioactivity measuring instrument manufacturers without using large-scale equipment.

MODE(S) FOR CARRYING OUT THE INVENTION

Each of the following Embodiments will be described in detail with reference to the drawings.

Embodiment 1

Figure 1:
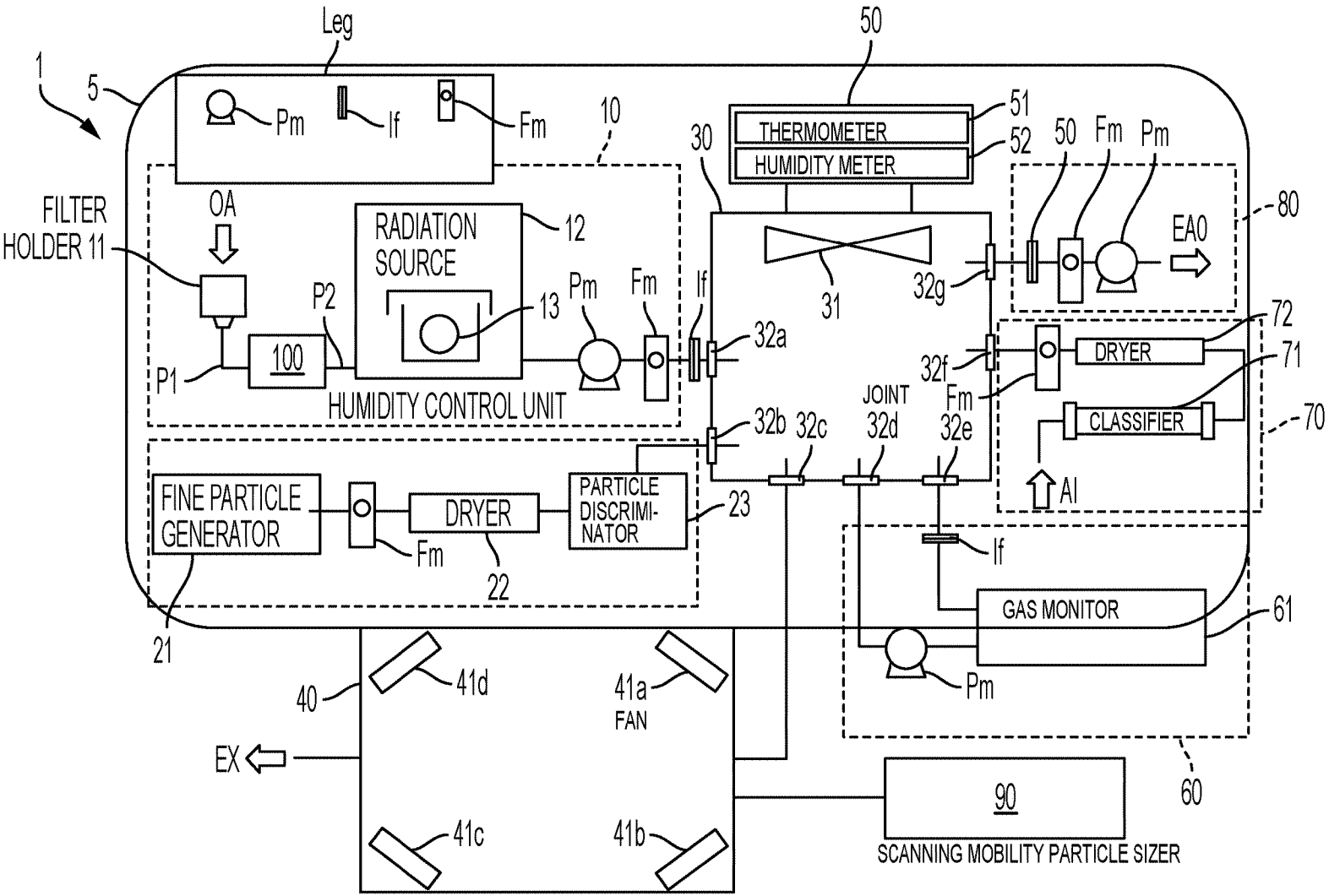
FIG. 1 shows a radioactive fine particle manufacturing system 1 of the present invention.

FIG. 1 shows a radioactive fine particle manufacturing system 1 of the present invention. In the narrow sense, the range enclosed by a frame line shown by reference numeral 5 corresponds to the radioactive fine particle manufacturing system. First, the radioactive fine particle manufacturing system 1 will be outlined and then each of its components will be described in detail. As shown in FIG. 1, the radioactive fine particle manufacturing system 1 comprises a radioactive gas generating system (Radioactive gas generating system: a radioactive gas generating apparatus) 10 for generating a natural radioactive noble gas (shown within the dotted line, the same hereinafter), a specific particle-sized aerosol generating system (Specific particle-sized aerosol generating system: a fine particle generating apparatus) 20 for generating a non-radioactive fine particle, and a mixing chamber (Mixing chamber) 30 for mixing the natural radioactive noble gas generated by the radioactive gas generating system 10 and the non-radioactive fine particle generated by the specific particle-sized aerosol generating system 20.

As shown in FIG. 1, the radioactive gas generating system 10 has a radiation source unit 12 that includes a natural radiation source 13 therein, which acquires open air (OA: Open Air) and allows the air to pass through a humidity control unit 100, then feeds the air to the radiation source unit 12. The function of the humidity control unit 100 will be described in detail in Embodiment 2. The radioactive gas generating system 10 mixes the air fed to the radiation source unit 12 and a natural radioactive noble gas generated from the natural radiation source 13 and feeds the same to the mixing chamber 30. The specific particle-sized aerosol generating system 20 includes a fine particle generator 21 for generating a fine particle and a particle discriminator 23 for discriminating a fine particle having a predetermined particle size, and discriminates a non-radioactive fine particle having a predetermined particle size from the non-radioactive fine particle generated by the fine particle generator 21 by using the particle discriminator 23 and feeds the non-radioactive fine particle to the mixing chamber 30. In the mixing chamber 30, a progeny nuclide converted by radioactive decay from the natural radioactive noble gas fed from the radioactive gas generating apparatus 10 is attached to the non-radioactive fine particle having a predetermined particle size fed from the specific particle-sized aerosol generating system 20 to generate a radioactive fine particle having a predetermined particle size. In FIG. 1, reference numeral 40 represents an exposure chamber (Exposure chamber) which is fed from the mixing chamber 30 a radioactive fine particle having a predetermined particle size. The function of the exposure chamber 40 will be described in detail in Embodiment 3.

Then, each of the components of the radioactive fine particle manufacturing system 1 will be described in detail. First, in FIG. 1, reference numeral Leg represents a legend of an instrument used in each of the components, and reference numeral Pm represents a pump (Pump), If represents an inline-filter-folder (Inline filter folder), and Fm represents a flow-meter (Flow meter). Illustrative preferred examples of the pump Pm include a low volume pump LV-40BW type (Product from Sibata Scientific Technology Ltd.: www.sibata.co.jp/attachment/catalog/pdf/lv-40bw.pdf) and a mini pump MP-Σ500N2 (Product from Sibata Scientific Technology Ltd.: www.sibata.co.jp/products/products2687/) or the like. However, the pump Pm is not restricted to the pump, but may be any of other small and lightweight suction pumps. Illustrative preferred examples of the inline-filter-folder If include a Nilu filter holder NL-I-01 (Effective filter area: 40 mmφ designed and developed by Norsk Institutt for luftforskning (NILU); and traded by Tokyo Dylec Corp.: www.t-dylec.net/products/pdf/nilu_filterfolder.pdf). However, the inline-filter-folder If is not restricted to the holder, but may be any of other inline-face-holders. Illustrative preferred examples of the flow-meter Fm include a small mass flow meter MF-FP10NH06-200-AI-ANV (Product from Kenis Limited.) or the like. However, the flow-meter Fm is not restricted to the mass flow meter, but may be any of other flow meters. In FIG. 1, elements with the same reference numerals such as pump Pm, inline-filter-folder If, and flow-meter Fm, denote the same elements, and hence a description thereof will be omitted.

As shown in the radioactive gas generating system 10 in FIG. 1, the open air OA is acquired through a filter-holder (Filter holder) 11. Illustrative preferred examples of the filter-holder 11 include a Nilu filter holder NL-O-01 (Effective filter area; 40 mmφ; designed and developed by NILU; and traded by Tokyo Dylec Corp.: www.t-dylec.net/products/pdf/nilu_filterfolder.pdf). However, the filter-holder 11 is not restricted to the holder, but may be any of other open face holders (atmospheric open type holder). The acquired open air OA is fed to the humidity control unit 100 through a pipe (duct) P1, and the air with controlled humidity is fed to the radiation source unit 12 through a pipe P2. The pipes P1 and P2 are clearly shown in FIG. 1 in order to clearly illustrate the configuration and arrangement of the humidity control unit 100 in Embodiment 2, and straight lines shown between other apparatuses shown in FIG. 1 represent pipes connecting such apparatuses. The air fed to the radiation source unit 12 through the pipe P2 is mixed with a natural radioactive noble gas generated from the natural radiation source 13. The natural radiation source 13 employed was $^{220}$Rn generated from an environmental sample such as soil or rocks. The natural radiation source 13 employed may be $^{222}$Rn. Illustrative preferred example of the environmental sample includes CAPTAIN STAG mantle (Th-containing mantle for lantern, Product from Pearl Metal Co., Ltd.). However, the sample is not restricted to the environmental sample, but may be any of other environmental samples. The natural radioactive noble gas generated in the radiation source unit 12 passes through the pump Pm and then the flow-meter Fm shown in the radioactive gas generating system 10 in order to be fed to the mixing chamber 30 through the inline-filter-folder If provided between the radioactive gas generating system 10 and the mixing chamber 30.

The specific particle-sized aerosol generating system 20 in FIG. 1 employed was a core condensation type monodisperse particle generator 3475 (Product from Tokyo Dylec Corp.). The fine particle generator is a condensation particle generator based on Sinclair-Lamer (Sinclair-Lamer) principle, and the minimum generated particle size is 0.1 μm to 0.8 μm, the generated flow rate is $10\times10^6$/cc, and the aerosol material is Carnauba Wax, etc. Firstly, in the specific particle-sized aerosol generating system 20, an aerosol generator (Aerosol generator: fine particle generator) 21 generates a fine particle. The aerosol generator 21 employed was an aerosol atomizer Model 3079 (Product from Tokyo Dylec Corp.). In the spraying method, when a small compressor disposed in the apparatus supplies pressurized air to an ejector nozzle, the resulting suction force in a nozzle portion absorbs a solution in the glass to allow the solution to be strongly sprayed onto the glass inner wall. In the method, large droplets are removed and only a stable minute aerosol particle passes through the outlet of the apparatus to be generated at this time (www.t-dylec.net/products/pdf/tsi_3079.pdf). The aerosol generator 21 is not restricted to the aerosol atomizer Model 3079, but may be any of other atomizers. The aerosol (non-radioactive fine particle) generated from the aerosol generator 21 passes through the flow-meter Fm and then is dried by removing moisture by a diffusion dryer (Diffusion Dryer) 22. The diffusion dryer 22 employed was a plastic pipe filled with silica gel. Any of adsorbents (activated carbon, etc.) other than silica gel may be used.

The aerosols generated from the aerosol generator 21 are polydisperse aerosols having a wide distribution of particle size. Herein, the particle size is an equivalent diameter (equivalent particle size) obtained by determining the particle size by measuring physical quantities depending the particle size, using scanning mobility particle size. When the polydisperse aerosols are fed to the mixing chamber 30, the resulting radioactive fine particles can have various particle sizes. Therefore, in order to prepare only aerosols (monodisperse aerosol) having a uniform and specific particle size (predetermined particle size) and feed the same to the mixing chamber 30, the aerosols that have passed through the diffusion dryer 22 are discriminated into aerosols having a specific particle size by an electrostatic classifier (Electrostatic Classifier: particle discriminator) 23. In principle, the electrostatic classifier 23 controls the particle size and classify a fine particle by controlling the applied voltage, using the electrical mobility of a charged particle in electric field is in inverse proportion to the particle size, and the electrical mobility relates to the applied voltage and the flow rate or the same of a fluid in which a particle are dispersed. The electrostatic classifier 23 employed was an electrostatic classifier Model 3080 (Product from Tokyo Dylec Corp.). The classifier is a differential mobility analyzer (Differential Mobility Analyzer: DMA). The particle discriminator may be any of those using other principles, such as electronic low pressure impactor ELPI+ (Product from Tokyo Dylec Corp.). The electronic low pressure impactor ELPI+ includes a plurality of collection stages (collection plates) for discriminating particle sizes of particles collected therein. After being sucked from the upper portion of the apparatus, particles with large inertia force hit upper collection plates, and those with small inertia force pass through the collection plates and go to lower collection plates. Specifically, the larger inertia force a particle has, the more likely it is collected on an upper-row collection plate. By measuring the weight of a collection plate before sampling a particle, the mass of a particle collected (collection mass) on the collection plate can also be determined. The above electrostatic classifier 23 discriminates a non-radioactive fine particle having a specific particle size to be fed to the mixing chamber 30 via a joint 32*b* (later-described) of the mixing chamber 30.

As shown in the mixing chamber 30 in FIG. 1, joints 32*a* to 32*g* for connecting pipes between other apparatuses are provided in the mixing chamber 30. The joint 32*a* is provided so as to connect a pipe between an inline-filter-folder If on the side of the above-described radioactive gas generating system 10 and the mixing chamber 30. The joint 32*b* is provided so as to connect a pipe between the specific particle-sized aerosol generating system 20 and the mixing chamber 30. As for other joints, the joint 32*c* connects a pipe between the exposure chamber 40 and the mixing chamber 30, the joints 32*d* and 32*e* connect a pipe between a radioactive gas monitor portion (later-described) 60 and the mixing chamber 30, the joint 32*f* connects a pipe between a dry air intake (later-described) 70 and the mixing chamber 30, and the joint 32*g* connects a pipe between a pressure adjusting portion (later-described) 80 and the mixing chamber 30. Reference numeral 31 represents a fan for stirring a gas in the mixing chamber 30. The size of the mixing chamber 30 is φ567.4 mm (outer shape)×602.4 mm (in height), and has a volume of 150 liters of equivalency (150-L vol.). However, the dimensions of the mixing chamber 30 are not restricted to the above dimensions.

In the mixing chamber 30, a natural radioactive noble gas fed from the radioactive gas generating system 10 is converted by radioactive decay into a progeny nuclide (solid particle). To be more precise, some are converted into progeny nuclides before coming into the mixing chamber 30, but the amount of such nuclides is very small. The progeny nuclide can attach to a non-radioactive fine particle having a specific particle size fed from the specific particle-sized aerosol generating system 20 to generate a radioactive fine particle having a specific particle size. When $^{220}$Rn is used as a natural radiation source 13 of the radioactive gas generating system 10, in the mixing chamber 30, each of the progeny nuclides $^{216}$Po→$^{212}$Pb→$^{212}$Bi→$^{212}$Po following $^{220}$Rn in thorium series attaches to a non-radioactive fine particle having a specific particle size fed from the specific particle size aerosol generating system 20 to be formed so as to include various radioactive fine particles having a specific particle size as a whole. The half-life of $^{212}$Pb→$^{212}$Bi is 10.64 hours and the half-life of $^{212}$Bi→$^{212}$Po is 60.55 minutes, which thus can manufacture a physically stable radioactive fine particle.

As shown in FIG. 1, an environmental monitor (Environmental monitor) 50 is connected to the mixing chamber 30, inside of which are provided a thermometer 51 and a relative humidity meter 52 to monitor the temperature and the relative humidity in the mixing chamber 30, respectively. The environmental monitor 50 employed was a data logger (Product from T&D Corporation (registered trademark): Thermo Recorder TR-73U: www.tandd.co.jp/product/tr7ui_series.html). The environmental monitor 50 is not restricted to the data logger, and any of other apparatuses for measuring the gas temperature and the relative humidity may be used.

As shown in FIG. 1, the radioactive gas monitor portion 60 is connected to the mixing chamber 30. In the radioactive gas monitor portion 60, a gas in the mixing chamber 30 is fed from a pipe connected by the joint 32*d* of the mixing chamber 30 to a radioactive gas monitor (Radioactive gas monitor) 61 by a pump Pm in the radioactive gas monitor portion 60. The gas monitored by the radioactive gas monitor 61 returns to the mixing chamber 30 via the joint 32*e* via the inline-filter-folder If in the radioactive gas monitor portion 60. The radioactive gas monitor 61 employed was an AB-5 Portable Radon Monitor (Product from AEGIS Instruments Ltd.). The radioactive gas monitor 61 is not restricted to the monitor, and any of other apparatuses for measuring the environmental radioactivity level with high precision may be used.

As shown in FIG. 1, the dry air intake 70 is connected to the mixing chamber 30. In the dry air intake 70, a monocular sieve filter device (Monocular sieve filter device) 71 isolates a contaminant and others from acquired air (AI: Air In), then a diffusion dryer 72 (as in the diffusion dryer 22 in the specific particle-sized aerosol generating system 20) dries the air and allows it to pass through the flow-meter Fm, and feeds it to the mixing chamber 30 via the pipe connected by the joint 32*f* The monocular sieve filter device 71 employed was a VACU-GUARD 150/Mol. Sieve (product from GE (registered trademark) Healthcare Japan co., Ltd.). The monocular sieve filter device 71 is not restricted to the apparatus, and any of other inline-filters for isolating a contaminant may be used.

As shown in FIG. 1, a pressure adjusting portion 80 is connected to the mixing chamber 30. In the pressure adjusting portion 80, a gas in the mixing chamber 30 is allowed to pass from a pipe connected via the joint 32*g* through the inline-filter If and the flow-meter Fm and be externally exhausted by the pump Pm (EAO: Excess air out). The pressure adjusting portion 80 adjusts the flow rate of the inflow system (radioactive gas generating system 10, specific particle-sized aerosol generating system 20, and dry air intake 70) in the mixing chamber 30 and the flow rate of the exhaust system (exposure chamber 40) so as to keep the pressure in the mixing chamber 30 at constant atmospheric pressure by the EAO.

In summary, the radioactive fine particle manufacturing system 1 of the present invention has a radioactive gas generating system 10 for generating a natural radioactive noble gas, a specific particle-sized aerosol generating system 20 for generating a non-radioactive fine particle, and a mixing chamber 30 for mixing the natural radioactive noble gas generated by the radioactive gas generating system 10 and the non-radioactive fine particle generated by the specific particle-sized aerosol generating system 20.

The radioactive gas generating system 10 has a radiation source unit 12 that includes a natural radiation source 13 therein, which acquires open air (OA) and allows the air to pass through a humidity control unit 100, then feeds the air to the radiation source unit 12. The radioactive gas generating system 10 mixes the air fed to the radiation source unit 12 and a natural radioactive noble gas generated from the natural radiation source 13 and feeds the same to the mixing chamber 30. The specific particle-sized aerosol generating system 20 includes an aerosol generator 21 for generating a fine particle and an electrostatic classifier 23 for discriminating a fine particle having a predetermined particle size, and discriminates a non-radioactive fine particle having a specific particle size from a non-radioactive fine particle generated by the aerosol generator 21 by using the electrostatic classifier 23 and feeds the non-radioactive fine particle having a predetermined particle size to the mixing chamber 30. The aerosols generated from the aerosol generator 21 are polydisperse aerosols having a wide distribution of particle size. When the polydisperse aerosols are fed to the mixing chamber 30, the resulting radioactive fine particle can have various particle sizes. Therefore, in order to prepare only aerosols having a uniform and specific particle size (monodisperse aerosol) and feed the same to the mixing chamber 30, the aerosols that have passed through the diffusion dryer 22 are discriminated into aerosols having a specific particle size by an electrostatic classifier 23. In the mixing chamber 30, a natural radioactive noble gas fed from the radioactive gas generating system 10 is converted by radioactive decay into a progeny nuclide. The progeny nuclide can attach to a non-radioactive fine particle having a specific particle size fed from the specific particle-sized aerosol generating system 20 to generate a radioactive fine particle having a specific particle size. When $^{220}$Rn is used as a natural radiation source 13 of the radioactive gas generating system 10, in the mixing chamber 30, each of the progeny nuclides $^{216}$Po→$^{212}$Pb→$^{212}$Bi→$^{212}$Po→$^{208}$Ti following $^{220}$Rn in thorium series attaches to a non-radioactive fine particle having a specific particle size fed from the specific particle-sized aerosol generating system 20 to be formed so as to include various radioactive fine particles having a specific particle size as a whole.

As described above, according to Embodiment 1 of the present invention, a simple radioactive fine particle manufacturing system 1, having a radioactive gas generating system 10, a specific particle-sized aerosol generating system 20, and a mixing chamber 30, can manufacture a radioactive fine particle using a natural radioactive nuclide without using large-scale equipment. In particular, a radioactive fine particle can be generated from a physically stable progeny nuclide converted by radioactive decay by using $^{220}$Rn as a natural radioactive nuclide. Furthermore, in order to attach a progeny nuclide only to an aerosol having a uniform and specific particle size (monodisperse aerosol), a radioactive fine particle having a specific particle size can be generated. Consequently, a radioactive fine particle manufacturing system 1 enabling performance evaluation of a radioactivity measuring instrument using an unprecedentedly novel physical indicator (particle size of aerosol) can be provided. The performance evaluation of a specific radioactivity measuring instrument using the particle size of an aerosol will be described in Embodiment 3 with reference to the use of the exposure chamber 40.

Embodiment 2

Figure 2:
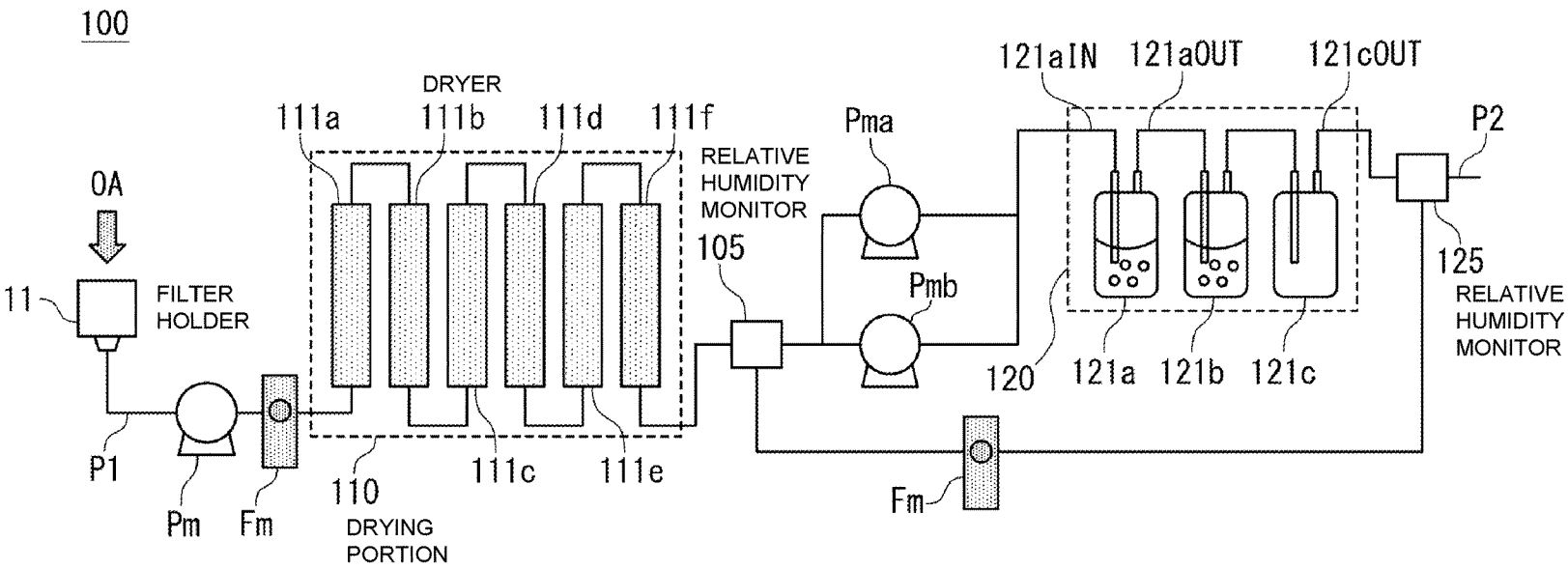
FIG. 2 shows the function of the humidity control unit 100.

As described in Background Art, it was found that in the technique for measuring $^{220}$Rn radioactivity concentrations, more water content in the air for feeding a gas contributes to more $^{220}$Rn emanated from a sample radiation source. Therefore, in Embodiment 2, a mechanism for controlling the radioactivity concentration of a natural radioactive noble gas generated from a natural radiation source 13 by controlling the humidity of the air fed to a radiation source unit 12, will be described. Specifically, the function of a humidity control unit 100 in a radioactive gas generating system 10 will be described. FIG. 2 shows the function of the humidity control unit 100. In FIG. 2, parts with the same reference signs as those in FIG. 1 denote the same elements, and hence a description thereof will be omitted. Pipes P1 and P2 shown as left and right edges in FIG. 2 correspond to the pipes P1 and P2 in the radioactive gas generating system 10 in FIG. 1, and as briefly described in Embodiment 1, a humidity control unit 100 shown in FIG. 2 is disposed between the pipe P1 and the pipe P2 in the radioactive gas generating system 10.

As shown in FIG. 2, after the open air OA is acquired through the pipe P1 via a filter-holder 11 by a pump Pm, the air passes through a flow-meter Fm to be fed to a drying portion 110. The drying portion 110 is composed of diffusion dryers (Diffusion Dryer) 111*a* 111*b*, 111*c*, 111*d*, 111*e*, and 111*f*, and the fed open air OA is dried after passing through the diffusion dryers in the order of 111*a* to 111*f*. The diffusion dryers 111*a* to 111*f*, which are the same components as the diffusion dryer 22 or 72 in Embodiment 1, and hence a description thereof will be omitted. The number of the diffusion dryers 111*a* to 111*f* is not restricted to 6, and any number of dryers can be connected as required. Dried air passing through the drying portion 110 passes through a temperature and relative humidity monitor 105 to be compressed by 2-line pumps Pma and Pmb and fed to a humidity regulator 120. The temperature and relative humidity monitor 105, which is the same component as the environmental monitor 50 described in Embodiment 1, and hence a description thereof will be omitted. As the 2-line pumps Pma and Pmb, the each maximum constant flow rate 5 L/min was used, and a constant flow rate of 10 L/min is obtained for both pumps Pma and Pmb. A 1-line (1-unit) pump may be used so long as it can obtain a constant flow rate of 10 L/min. The flow rate is measured by a flow-meter Fm equipped between the temperature and relative humidity monitors 105 and 125.

There are equipped washing bottles 121*a*, 121*b*, and 121*c* in the humidity regulator 120, and the air compressed by the 2-line pumps Pma and Pmb is fed to the washing bottles in the order of 121*a* to 121*c*. For example, the air compressed by both of the pumps Pma and Pmb is fed from a pipe 121*a*IN to the washing bottle 121*a*, passes through the water in the washing bottle 121*a* to add vapor thereto to be converted into humidified air, and fed from a pipe 121*a*OUT to the following washing bottle 121*b*. The water in the washing bottle 121*a* employed is pure water or purified water. The humidified air fed from the washing bottle 121*a* is also humidified in the washing bottle 121*b*. Meanwhile, the washing bottle 121*c* contains no water, and the bottle is used for dehumidifying compressed air. Finally, the air having desired controlled humidity fed from the washing bottle 121*c* passes through a pipe 121*c*OUT and is fed to the temperature and relative humidity monitor 125 to be went out from the pipe P2. Since the amount of the relative humidity is determined by defining the temperature, the humidity regulator 120 increases or decreases the humidification amount in the washing bottles 121*a* and 121*b* and increases or decreases the relative humidity by using heating and cooling apparatuses (each not shown) equipped in the washing bottles 121*a* to 121*c* accordingly. By lowering the temperature of the washing bottle 121*c* as required, the humidity of compressed air fed to the washing bottle 121*c* is lowered. The humidity regulator 120 controls the air humidity by controlling the heating and cooling of the washing bottle 121*a* to 121*c* by using the temperature and relative humidity monitor 105 at the inlet of the humidity regulator 120 and the temperature and relative humidity monitor 125 at the outlet thereof. The number of the washing bottles 121*a* to 121*c* in the humidity regulator 120 is not restricted to 3, and any number of bottles can be equipped. The washing bottle employed was a gas washing bottle (Product from As One Corporation (registered trademark), "AS ONE (registered trademark) Comprehensive Laboratory Equipment & Supplies Catalogue 2017", P. 1340). The washing bottle is not restricted to the gas washing bottle, and any of other washing bottles may be used.

In summary, the radioactive gas generating system 10 further includes a humidity control unit 100 for controlling the humidity of acquired open air OA and feeding the air to the radiation source unit 12. By allowing the externally acquired open air OA to pass through the humidity control unit 100 and feeding the humidity-controlled air to the radiation source unit 12, the radioactivity concentration of a natural radioactive noble gas generated from the natural radiation source 13 can be controlled. The natural radiation source 13 can be not only $^{220}$Rn, but also $^{222}$Rn.

As described above, according to Embodiment 2 of the present invention, in order to manufacture a radioactive fine particle using a radioactive noble gas of short half-life ($^{220}$Rn or $^{222}$Rn), a radioactive fine particle manufacturing system or the like indicative of a specific method for controlling radioactivity concentrations based on air humidity can be provided.

Embodiment 3

In Embodiment 3 of the present invention, a radioactive fine particle manufacturing system 1 capable of implementing performance evaluation of the overall radioactivity measuring instrument will be described.

As shown in FIG. 1, the radioactive fine particle manufacturing system 1 includes an exposure chamber 40 being fed with a radioactive fine particle having a specific (predetermined) particle size from a mixing chamber 30. The exposure chamber 40 is connected to the mixing chamber 30 via a joint 32*c*. There are provided in the exposure chamber 40, fans 41*a*, 41*b*, 41*c*, and 41*d* for stirring a gas in the exposure chamber 40. The exposure chamber 40 has a volume of 540 liters of equivalency (540-L vol.), with dimensions in length, width and height=600 mm×1500 mm×600 mm. However, the number of fans in the exposure chamber 40 and the volume and dimensions or the like of the exposure chamber 40 are not restricted to the above numbers and values. The exposure chamber 40 employed was a commercially available vacuum glove box or a glove box system or the like.

As shown in FIG. 1, a scanning mobility particle sizer (Scanning Mobility Particle Sizer (SMPS): scanning mobility particle sizer Model 3034, Product from Tokyo Dylec Corp.) 90 is connected to the exposure chamber 40. The scanning mobility particle sizer 90 is an apparatus combining the above-described differential mobility analyzer (DMA) and a condensation particle counter (CPC) for measuring particles. The number of monodisperse particles having a particle size in accordance with the DMA's set voltage running from DMA is counted by CPC to measure the number concentration and the distribution of particle size. The radioactive fine particles that have reached the half-life and also those that haven't reached the half-life are exhausted from an exhaust (Exhaust: EX) into open air.

Experimental Example

Experimental Example in which a radioactive fine particle manufacturing system 1 is used to generate a radioactive aerosol and a radiation meter is calibrated using the radioactive aerosol is described. The natural radiation source 13 in the radioactive gas generating system 10 employed was $^{222}$Rn (radon) in uranium series. Obviously, $^{220}$Rn (thoron) in thorium series may be used. A natural radioactive noble gas $^{222}$Rn generated in the radioactive gas generating system 10 and a non-radioactive fine particle generated by the aerosol generator (aerosol atomizer Model 3079) 21 in the specific particle-sized aerosol generating system 20 and classified into a specific particle size are placed in the mixing chamber 30 to attach a radon progeny nuclide to the non-radioactive fine particle and generate a radioactive fine particle. Using the radioactive fine particle, a radiation meter (radon progeny nuclide monitor for alpha ray equipped with a semiconductor detector) was calibrated.

Figure 3:
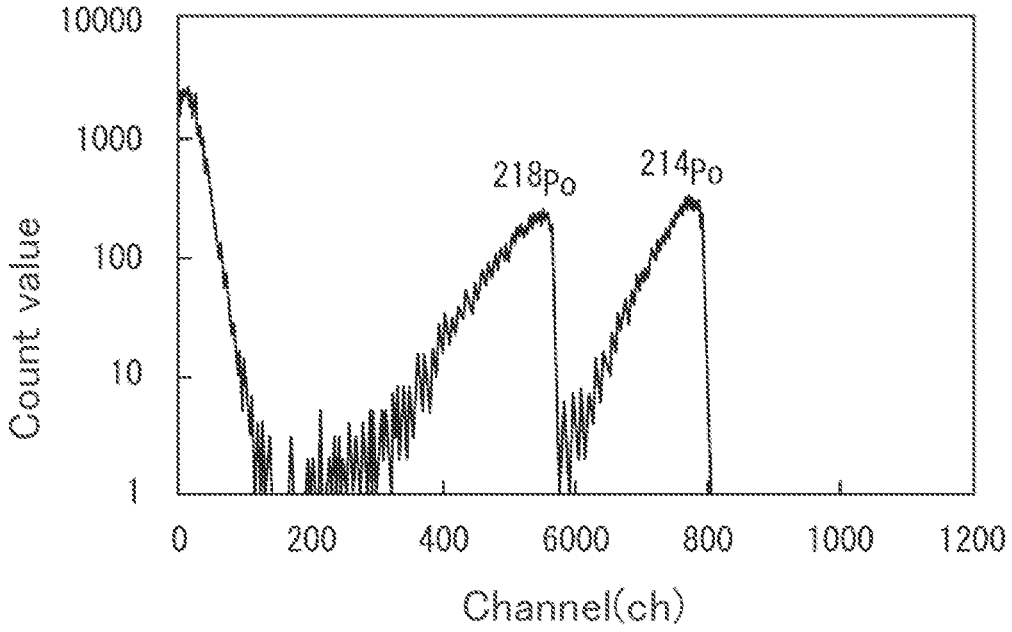
FIG. 3 shows a graph indicative of the results of the measurement (detection) by the above radiation meter.

The exposure chamber 40 includes an externally removable filter (not shown) for collecting a radioactive fine particle having a specific particle size fed from the mixing chamber 30. The radioactive fine particle of a radon progeny nuclide in the exposure chamber 40 was collected in the above filter, and the filter was removed from a sampling port (not shown) on the external wall of the exposure chamber 40 to measure the filter by the above radiation meter placed in a laboratory (not shown). FIG. 3 shows a graph indicative of the results of the measurement (detection) by the above radiation meter. In FIG. 3, the horizontal line shows the channel (ch) and the vertical line shows the count value. As shown in FIG. 3, the energy peaks of alpha rays from a radon progeny nuclide $^{218}$Po and a radon progeny nuclide $^{214}$Po were detected. Based on the peaks, an energy region to be measured was set (calibrated).

In summary, the radioactive fine particle manufacturing system 1 has an exposure chamber 40 being fed with a radioactive fine particle having a specific (predetermined) particle size from the mixing chamber 30. The exposure chamber 40 is connected to the mixing chamber 30 via a joint 32*c*. The exposure chamber 40 includes an externally removable (exposure chamber 40's) filter for collecting a radioactive fine particle having a specific particle size fed from the mixing chamber 30. A radioactive fine particle of a radon progeny nuclide in the mixing chamber 40 is collected in the above filter, and the filter is removed from a sampling port on the external wall of the exposure chamber 40 to measure the filter by a radiation meter placed in the laboratory to calibrate the radiation meter.

As described above, according to Embodiment 3 of the present invention, a radioactive fine particle manufacturing system or the like capable of implementing performance evaluation of the overall radioactivity measuring instrument manufactured by radioactivity measuring instrument manufacturers without using large-scale equipment can be provided.

The radioactive fine particle manufactured by the radioactive fine particle manufacturing system 1 can be thought of as a traceable thoron or radon standard source. Accordingly, the comparison of the radioactivity level of a standard source and the results measured by the above radiation meter can calibrate the radiation meter. Although ensuring of the traceability of measuring apparatuses with regard to radioactivity measurement is strongly desired in the world, the measuring equipment or the like for that is believed to be insufficient. This radioactive fine particle manufacturing system 1 is a system for manufacturing a simple radioactive fine particle capable of use as a standard source, and it can be a standard technique for ensuring the traceability of measuring apparatuses with regard to radioactivity measurement.

The performance evaluation of a specific radioactivity measuring instrument, using a particle size of an aerosol described in Embodiment 1, will be described. A thoron decay product deposition monitor can be used as the radioactivity measuring instrument. The thoron decay product deposition monitor is a measuring instrument for measuring radiation emanated by a thoron decay product that is present in the air and deposited on the surface of a measuring portion or the like of a monitor.

Figure 4:
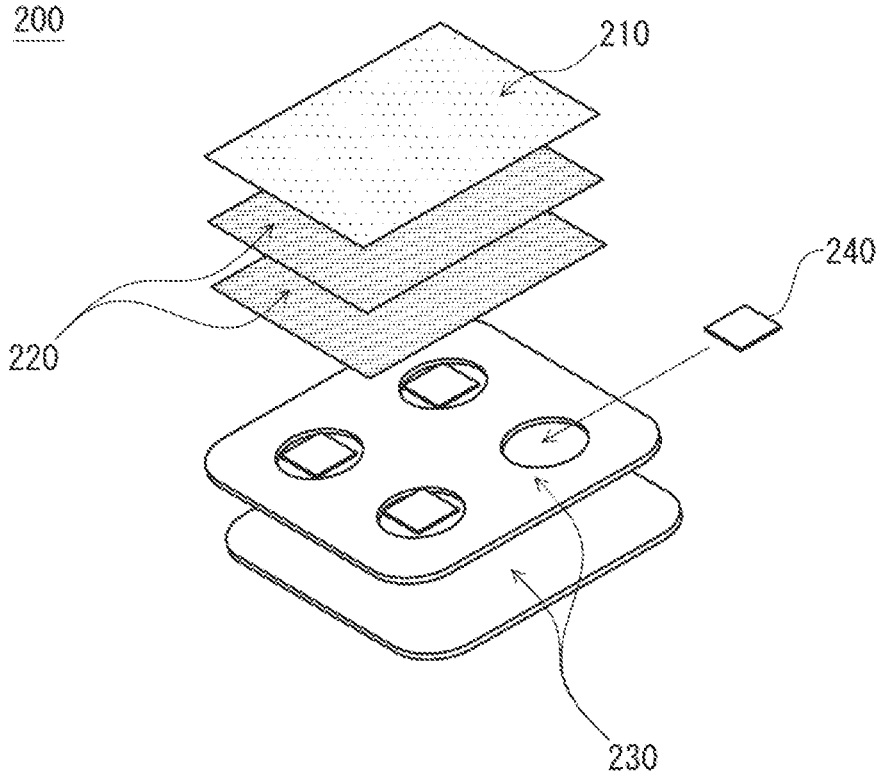
FIG. 4 shows the outline of a passive thoron progeny nuclide monitor 200 as one example of the above thoron decay product deposition monitor.

FIG. 4 shows the outline of a passive thoron progeny nuclide monitor 200 as one example of the above thoron decay product deposition monitor. In FIG. 4, reference numeral 240 denotes CR-39 (registered trademark) (a type of plastic lens) of a solid track detector, 230 a stainless plate for disposing CR-39 (registered trademark) (240), 220 an aluminum film of aluminum evaporation for covering CR-39 (registered trademark) (240), and 210 polypropylene for covering the aluminum film 220. In the CR-39 (registered trademark) (240), α-ray damages chemical bond of an element thereof. When the damage from damage received is etched by a strong alkaline solution, it can be detected with optical microscope. Since there is a linear relationship between the number of damages and the radioactivity concentration, it is used as a thoron decay product deposition monitor. The aluminum film 220 for covering the CR-39 (registered trademark) (240) and the polypropylene 210 function as an energy moderator. The thickness of the aluminum film 220 and the polypropylene 210 is properly determined such that α-ray of only Po-212 emanating a highest energy level of 8.8 MeV, out of the energy emanated by a thoron progeny nuclide attached to their surfaces, can be detected. In FIG. 4, two aluminum films 220 and one polypropylene 210 are shown, but these numbers can be set accordingly. It can be said that the passive thoron progeny nuclide monitor 200 is a measuring apparatus using the physical phenomenon of a radioactive fine particle to attach to the surface of a material by diffusive attaching. The comparison of the exposure concentration of the passive thoron progeny nuclide monitor 200 and the number of etch pits (holes of damages generated in CR-39 (registered trademark) (240)) found that the thoron decay product exposure concentration (by traceable thoron standard source manufactured by the radioactive fine particle manufacturing system 1) is 902 ($Bqhm^{-3}$) (h denotes time-integrated value of radioactivity concentrations), and the number of etch pits is 2.5 ($mm^{-3}$). In the comparison, the particle size of a radioactive fine particle can be varied for measurement.

According to the particle size of an aerosol, the deposition on the thoron decay product deposition monitor may vary. Therefore, performance evaluation of response by particle size in the thoron decay product deposition monitor can be implemented, based on a specific particle size of a radioactive fine particle deposited on the thoron decay product deposition monitor and discriminated by the electrostatic classifier 23 and radiation emanated from the radioactive fine particle. As in the above Experimental Example, in performance evaluation, a radioactive fine particle in the exposure chamber 40 was collected in the above filter, and the filter was removed from a sampling port on the external wall of the exposure chamber 40 to measure the filter by the thoron decay product deposition monitor placed in the laboratory. The thoron decay product deposition monitor and others are disclosed in the following documents (Document 1. Zhuo, W. and Iida, T. "Estimation of thoron progeny concentrations in dwellings with their deposition rate measurements.", Jpn J. Health Phys. 35 (3), 365-370 (2000). Document 2. Tokonami, S. "Why is $^{220}$Rn (thoron) measurement important?", Radiat. Prot. Dosim. 141 (4), 335-339 (2010).). As described above, a radioactive fine particle manufacturing system 1 and others capable of implementing performance evaluation of a radioactivity measuring instrument (e.g. thoron decay product deposition monitor) using an unprecedentedly novel physical indicator (particle size of aerosol) can be provided.

Embodiment 4

The above-described Embodiments 1 to 3 described the configuration and functions of the radioactive fine particle manufacturing system 1. The Embodiment 4 is described with reference to a radioactive fine particle manufacturing method. As described above, the radioactive fine particle manufacturing system 1 includes a radioactive gas generating system (radioactive gas generating apparatus) 10 for generating a natural radioactive noble gas, a specific particle-sized aerosol generating system (fine particle generating apparatus) 20 for generating a non-radioactive fine particle, and a mixing chamber 30 for mixing the natural radioactive noble gas generated by the radioactive gas generating system 10 and the non-radioactive fine particle generated by the specific particle-sized aerosol generating system 20, and the radioactive fine particle manufacturing method is a manufacturing method employing the radioactive fine particle manufacturing system 1 including the above components.

With reference to FIG. 1, in the radioactive gas generating system 10, externally acquired open air OA is fed to a radiation source unit 12 including a natural radiation source 13 therein, and a natural radioactive noble gas is generated from the air and the natural radiation source 13 to be fed to the mixing chamber 30 (step of generating a natural radioactive noble gas). The natural radiation source 13 is preferably $^{220}$Rn generated from an environmental sample. In the specific particle-sized aerosol generating system 20, a non-radioactive fine particle is generated by an aerosol generator (fine particle generator) 21 for generating a fine particle, and the non-radioactive fine particle is fed to mixing chamber 30 by discriminating a non-radioactive fine particle having a specific particle size by a differential mobility analyzer (particle discriminator) 23 for discriminating a fine particle having a specific (predetermined) particle size (step of generating a non-radioactive fine particle). The step of generating a natural radioactive noble gas and the step of generating a non-radioactive fine particle can be taken in parallel. Then, in the mixing chamber 30, a progeny nuclide converted by radioactive decay from the natural radioactive noble gas fed from the radioactive gas generating system 10 in the step of generating a natural radioactive noble gas attaches to a non-radioactive fine particle having a specific particle size fed from the specific particle-sized aerosol generating system 20 in the step of generating a non-radioactive fine particle to generate a radioactive fine particle having a specific particle size (step of generating a radioactive fine particle).

The radioactive gas generating system 10 can further include a humidity control unit 100 for feeding acquired open air OA by controlling the humidity of the air. In this case, the above step of generating a natural radioactive noble gas can control the radioactivity concentration of the natural radioactive noble gas generated by feeding the externally acquired open air OA to a radiation source unit 12 after allowing the acquired open air OA to pass through the humidity control unit 100.

The radioactive gas generating system 10 can further include an exposure chamber 40 to be connected to the mixing chamber 30. The radioactive fine particle having a specific particle size of the mixing chamber 30 generated in the above step of generating a radioactive fine particle is fed to the exposure chamber 40, and the radioactive fine particle is collected by an externally removable filter included in the exposure chamber 40 (step of collecting a radioactive fine particle).

In summary, a natural radioactive noble gas is generated from externally acquired open air OA and the natural radiation source 13 in the step of generating a natural radioactive noble gas by using the radioactive fine particle manufacturing system 1, and fed to the mixing chamber 30. A non-radioactive fine particle is generated by an aerosol generator 21 of the specific particle-sized aerosol generating system 20 in the step of generating a non-radioactive fine particle, and a non-radioactive fine particle having a specific particle size is discriminated by a differential mobility analyzer 23 to be fed to the mixing chamber 30. In the mixing chamber 30 in the step of generating a radioactive fine particle, a progeny nuclide converted by radioactive decay from a natural radioactive noble gas fed in the step of generating a natural radioactive noble gas attaches to a non-radioactive fine particle having a specific particle size fed in the step of generating a non-radioactive fine particle to generate a radioactive fine particle having a specific particle size. The above step of generating a natural radioactive noble gas can control the radioactivity concentration of a natural radioactive noble gas generated by feeding externally acquired open air OA to the radiation source unit 12 after allowing the air to pass through the humidity control unit 100. In the step of collecting a radioactive fine particle, a radioactive fine particle having a specific particle size of the mixing chamber 30 generated in the above step of generating a radioactive fine particle is fed to the exposure chamber 40 connected to the mixing chamber 30, and the radioactive fine particle is collected by an externally removable filter included in the exposure chamber 40.

As described above, according to Embodiment 4 of the present invention, by the radioactive fine particle manufacturing method employing the radioactive fine particle manufacturing system 1, a radioactive fine particle can be manufactured from a natural radioactive nuclide without using large-scale equipment. A radioactive fine particle can be manufactured from a physically stable progeny nuclide converted by radioactive decay by using $^{220}$Rn as a natural radioactive nuclide in particular. Furthermore, a radioactive fine particle having a specific particle size can be generated because of attaching a progeny nuclide only to an aerosol having a uniform and specific particle size (monodisperse aerosol), Consequently, performance evaluation of a radioactivity measuring instrument using an unprecedentedly novel physical indicator (particle size of aerosol) can be implemented. When a radioactive fine particle is manufactured using a radioactive noble gas of short half-life ($^{220}$Rn or $^{222}$Rn) a specific method for controlling radioactivity concentrations based on air humidity can be shown. The method is not restricted to calibration of a chamber for a gas monitor, and performance evaluation of the overall radioactivity measuring instrument can be implemented.

Embodiment 5

As a controlled experiment of a radioactive aerosol with regard to the radioactive fine particle manufacturing system 1, the inventor measured the number concentration and the particle size of the radioactive aerosol in the mixing chamber 30 under various conditions. In measurement, a SMPS90 connected to the exposure chamber 40 was used in the mixing chamber 30 as well (see FIG. 1).

Controlled Experiment of Radioactive Aerosol (Number Concentration).

Figure 5:
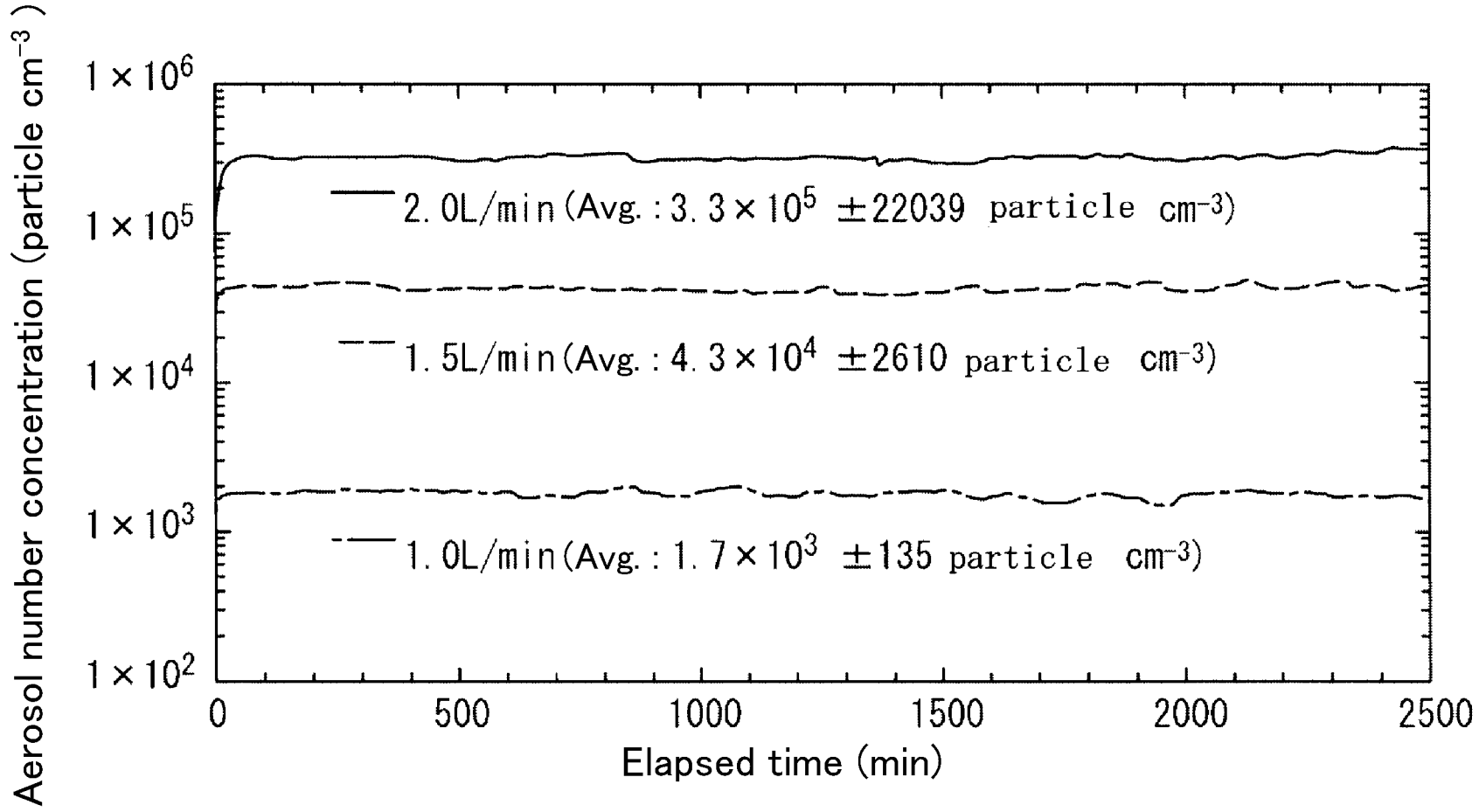
FIG. 5 shows a graph indicative of the measurement results of a radioactive aerosol with regard to number concentration.

FIG. 5 shows a graph indicative of the measurement results of a radioactive aerosol with regard to number concentration. In FIG. 5, the horizontal line shows the elapsed time (min) and the vertical line shows the (radioactive) aerosol number concentration (particle $cm^{-3}$). As shown in FIG. 5, the flow rate of an aerosol generator 21 (see FIG. 1) of a radioactive aerosol was determined as 3 conditions: 1.0 L/min (dashed line), 1.5 L/min (chain line), and 1.0 L/min (solid line). As shown in FIG. 5, when the flow rate is 1.0 L/min, the number concentration of the (radioactive) aerosol was $1.7\times10^3\pm135$ (particle $cm^{-3}$) on average, when the flow rate was 1.5 L/min, the number concentration of the (radioactive) aerosol was $4.3\times10^4\pm2610$ (particle $cm^{-3}$) on average, and when the flow rate was 2.0 L/min, the number concentration of the (radioactive) aerosol was $3.3\times10^5\pm22039$ (particle $cm^{-3}$) on average. FIG. 5 shows that the radioactive aerosol number concentration depends on the flow rate and increases accordingly. In addition, it was found that the radioactive aerosol number concentration is stable as time elapses.

Controlled Experiment of Radioactive Aerosol (Particle Size).

Figure 6:
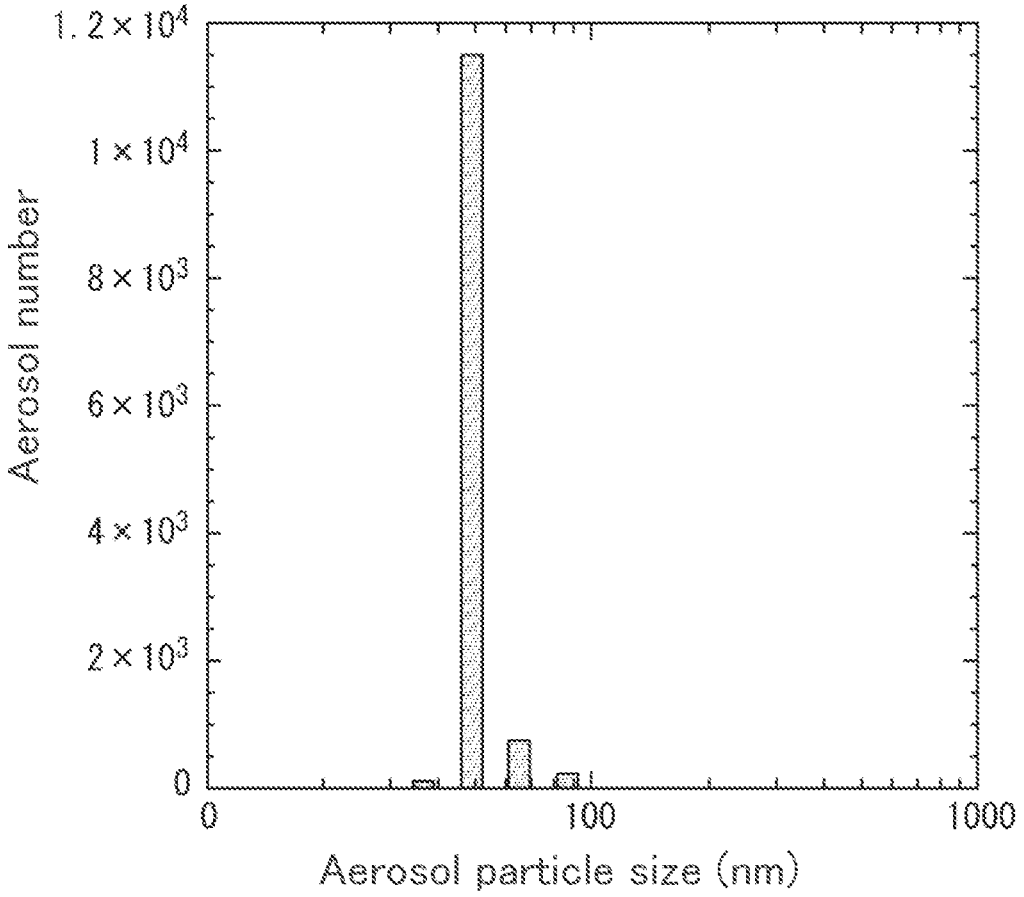
FIG. 6 shows a graph indicative of the measurement results of a radioactive aerosol with regard to particle size.

FIG. 6 shows a graph indicative of the measurement results of a radioactive aerosol with regard to particle size. In FIG. 6, the horizontal line shows the (radioactive) aerosol particle size (nm) and the vertical line shows the (radioactive) aerosol number (particle). As shown in FIG. 6, it was confirmed that the distribution of particle size of the radioactive aerosol is concentrated around approx. 50 nm, and a radioactive aerosol having a constant fine particle size can be generated.

As a controlled experiment of the radon concentration and the thoron concentration with regard to the radioactive fine particle manufacturing system 1, the inventor measured the time variation of the radon concentration and the thoron concentration in the exposure chamber 40. In measurement, in addition to a SMPS 90 connected to the exposure chamber 40, a radioactive gas monitor portion 60 connected to the mixing chamber 30 was used (see FIG. 1). The radon concentration (or thoron concentration) was measured using a commercially available pulse ionization chamber (Name of product: ALPHAGUARD-RADON MONITOR: Product from bertin INSTRUMENTS company) as a radioactive gas monitor 61. As an alternative of the radioactive gas monitor 61, the above-described scintillation cell (Name of product: AB-5) may be used.

Controlled Experiment of Radon Concentration.

Figure 7:
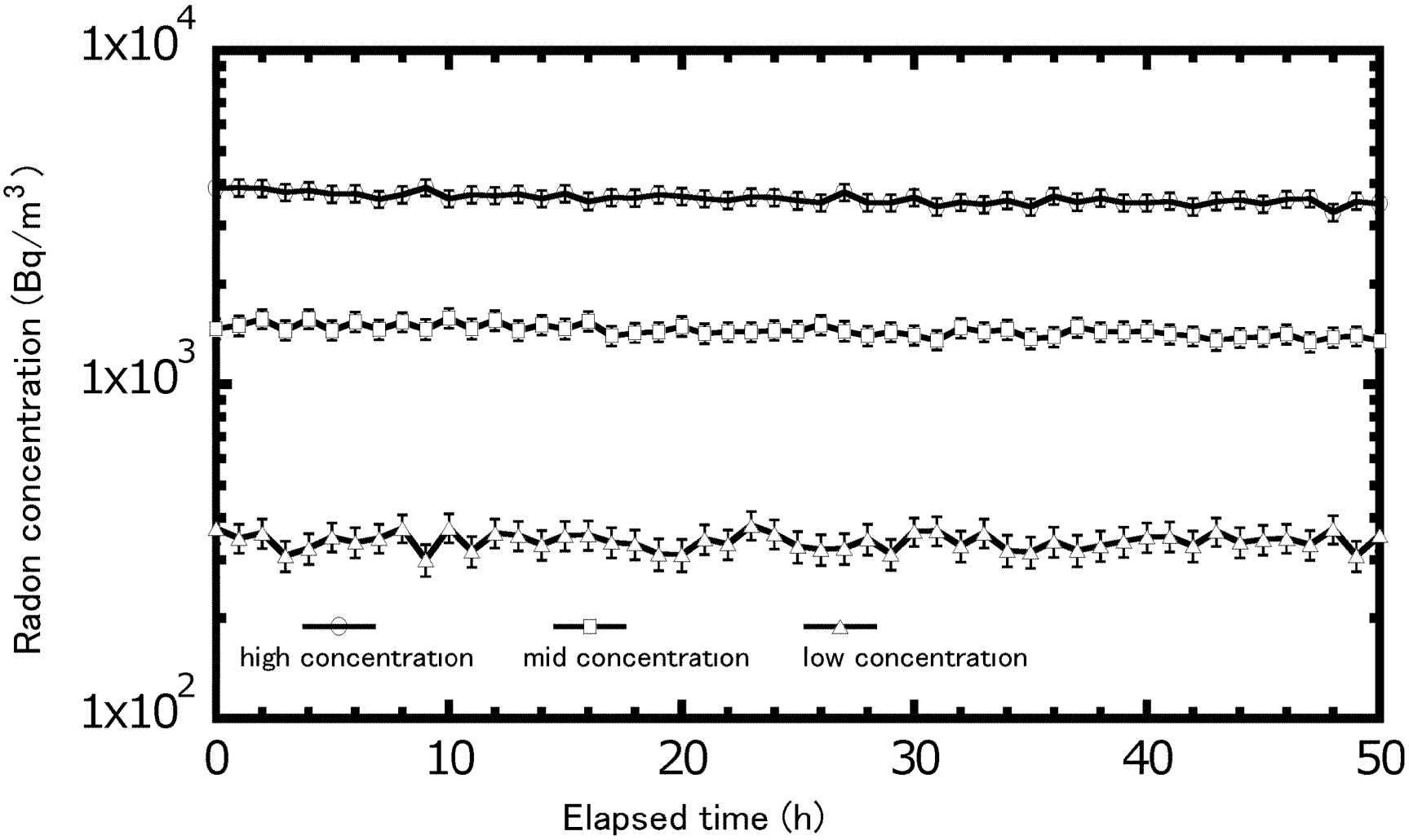
FIG. 7 shows a graph indicative of changes in radon concentration in the exposure chamber 40.

FIG. 7 shows a graph indicative of changes in radon concentration in the exposure chamber 40. In FIG. 7, the horizontal line shows the elapsed time (h) and the vertical line shows the radon concentration (Bq/m$^3$). As shown in FIG. 7, in measurement, the radon concentration was determined as high concentration (circular) approx. 4,000 (Bq/m$^3$), mid concentration (rectangle) approx. 1,500 (Bq/m$^3$), and low concentration (triangle) approx. 350 (Bq/m$^3$). As obviously shown in FIG. 7, it was found that the radon concentration is stable as time elapses. In detail, the average radon concentration in the exposure chamber 40 was determined controllable in the range of approx. 350 to 4,000 (Bq/m$^3$).

Controlled Experiment of Thoron Concentration.

Figure 8:
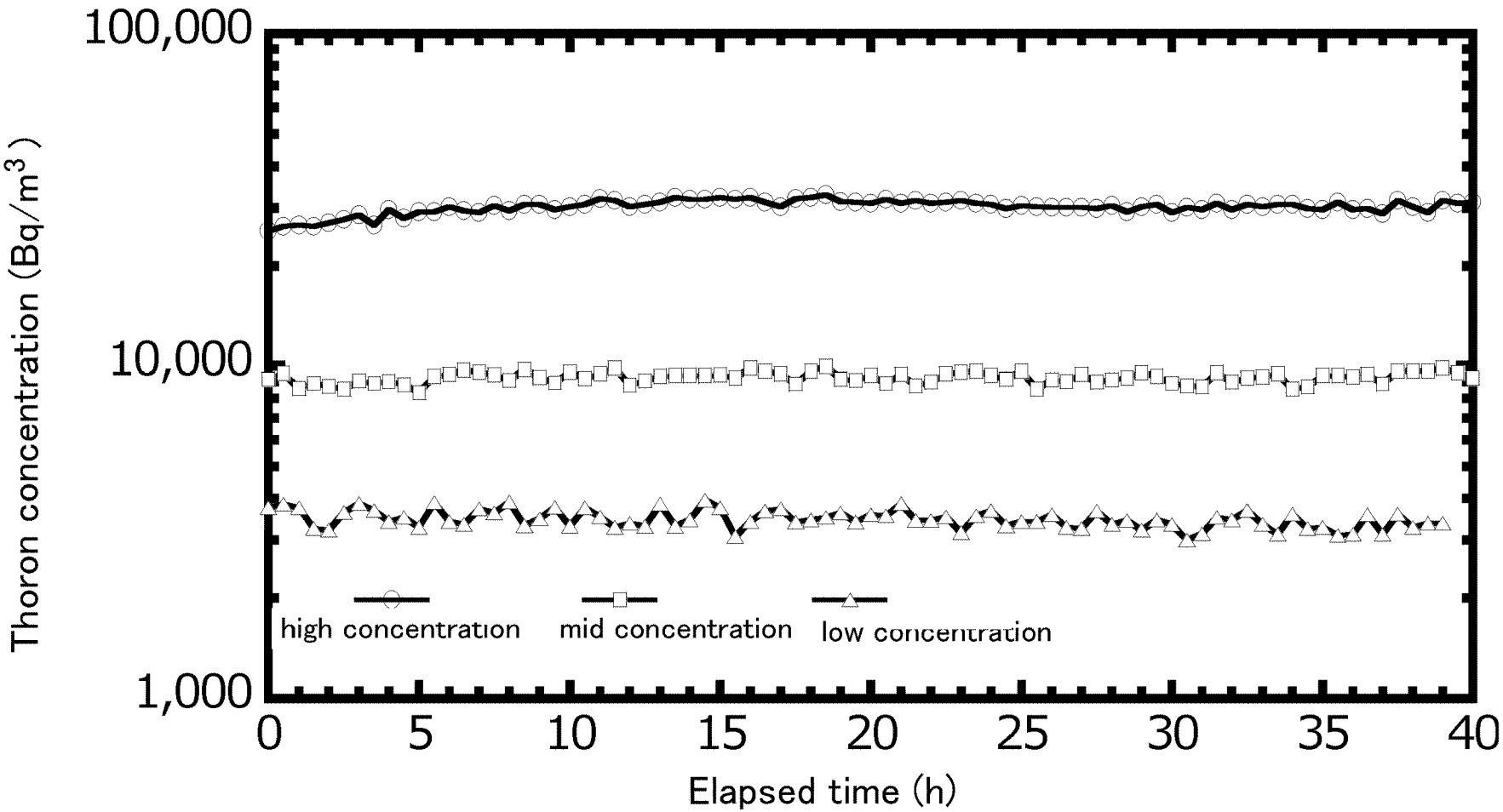
FIG. 8 shows a graph indicative of changes in thoron concentration in the exposure chamber 40.
Figure 9:
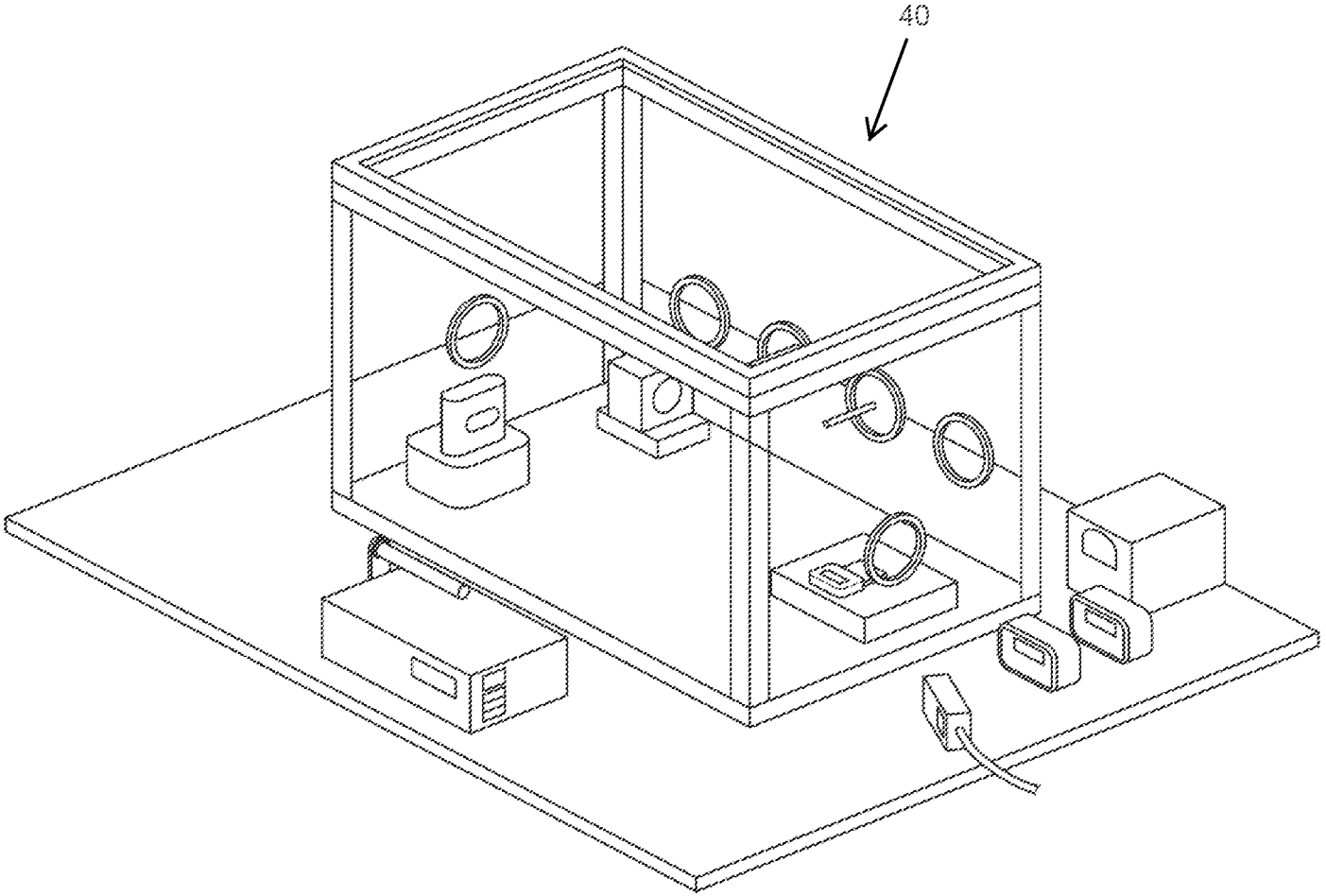
FIG. 9 shows a black-and-white line drawings (partially) of the exposure chamber 40.

FIG. 8 shows a graph indicative of changes in thoron concentration in the exposure chamber 40. In FIG. 8, the horizontal line shows the elapsed time (h) and the vertical line shows the thoron concentration (Bq/m$^3$). As shown in FIG. 8, in measurement, the thoron concentration was determined as high concentration (circular) approx. 28,000 (Bq/m$^3$), mid concentration (rectangle) approx. 9,000 (Bq/m$^3$), and low concentration (triangle) approx. 3,500 (Bq/m$^3$). As obviously shown in FIG. 8, it was found that the thoron concentration is stable as time elapses. In detail, the average thoron concentration in the exposure chamber 40 was determined controllable in the range of approx. 3,500 to 28,000 (Bq/m$^3$).

As described above, according to Embodiment 5 of the present invention, as a controlled experiment of a radioactive aerosol with regard to the radioactive fine particle manufacturing system 1, the inventor measured the number concentration and the particle size of the radioactive aerosol in the mixing chamber 30 under various conditions. Consequently, it was found that the radioactive aerosol number concentration depends on the flow rate and increases accordingly. In addition, it was found that the radioactive aerosol number concentration is stable as time elapses. It was confirmed that the distribution of particle size of a radioactive aerosol is concentrated around approx. 40 nm, and a radioactive aerosol having a constant fine particle size can be generated. As a controlled experiment of the radon concentration and the thoron concentration with regard to the radioactive fine particle manufacturing system 1, the inventor measured the time variation of the radon concentration and the thoron concentration in the exposure chamber 40. Consequently, it was found that the radon concentration is stable as time elapses. In detail, the average radon concentration in the exposure chamber 40 was determined controllable in the range of approx. 350 to 3,500 (Bq/m$^3$). It was found that the thoron concentration is stable as time elapses. In detail, the average thoron concentration in the exposure chamber 40 was determined controllable in the range of approx. 3,500 to 28,000 (Bq/m$^3$).

Figure 10:
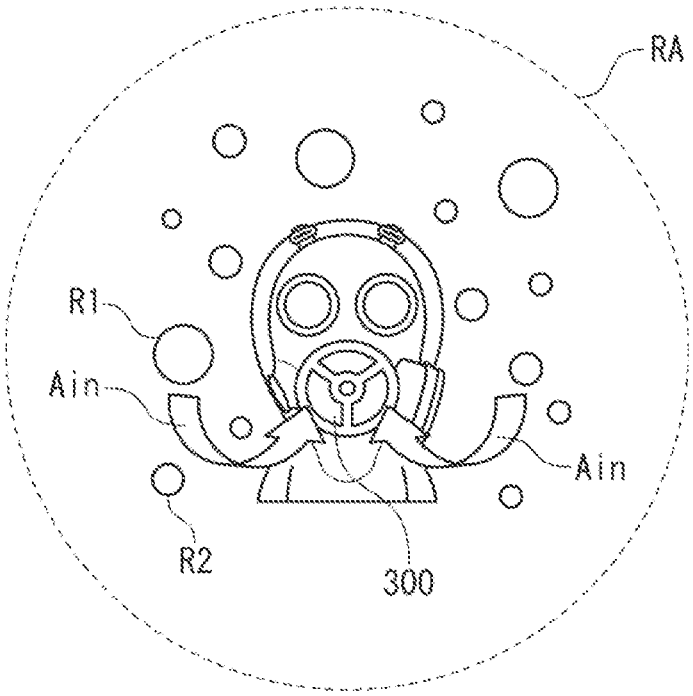
FIG. 10 shows the concept of performance evaluation of a protective mask in the field of labor health required in the radioactive fine particle manufacturing system 1 of the present invention.

FIG. 10 is a black-and-white line drawing (partially) of the exposure chamber 40.

Embodiment 6

Figure 11:
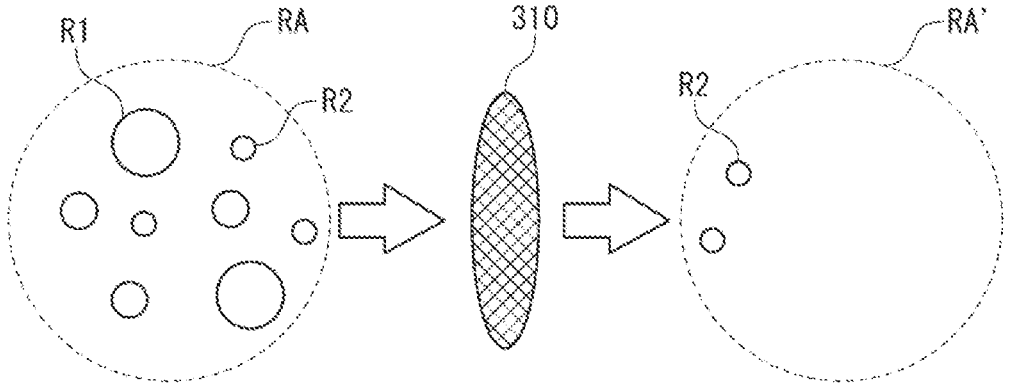
FIG. 11 shows the concept of collecting a radioactive fine particle R1 and others by a filter (filter paper) 310 disposed in the protective mask 300.

As a utilization example of the present invention, it can be used for precise performance evaluation of air dust catching filter papers, dust masks and others. FIG. 10 shows the concept of performance evaluation of a protective mask in the field of labor health required in the radioactive fine particle manufacturing system 1 of the present invention. In FIG. 10, reference numeral 300 denotes a protective mask (dust mask), and R1 and R2 or the like a radioactive fine particle. When an operator works by wearing a protective mask 300 in an area RA where a radioactive fine particle R1 or the like is present, the radioactive fine particle R1 or the like in the area RA is acquired as air flow Ain in the protective mask 300. FIG. 11 shows the concept of collecting a radioactive fine particle R1 and others by a filter (filter paper) 310 disposed in the protective mask 300. In FIG. 11, parts with the same reference signs as those in FIG. 10 denote the same elements, and hence a description thereof will be omitted. As shown in FIG. 11, the radioactive fine particle R1 and others present in the area RA are collected by the filter 310, and the amount is smaller in an area RA' (in the protective mask 300). Therefore, performance evaluation (collection efficiency, durability, etc.) of the filter 310 is required.

Figure 12:
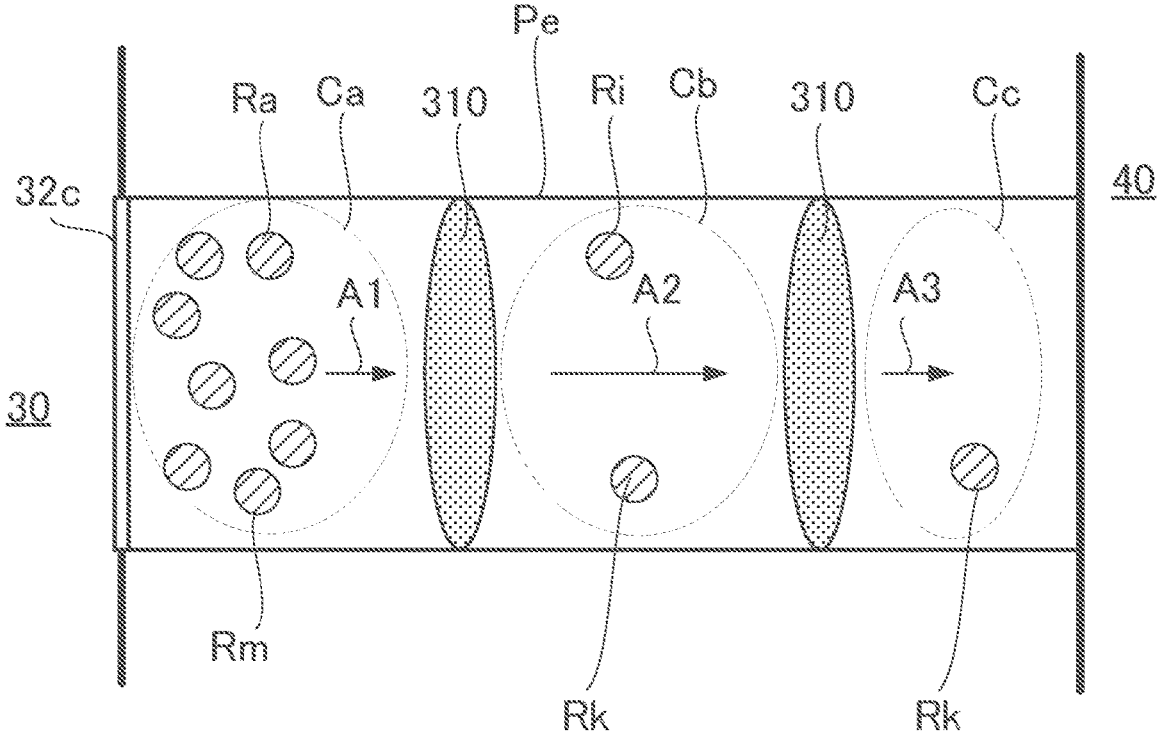
FIG. 12 shows a utilization example of the radioactive fine particle manufacturing system 1 to implement performance evaluation of the filter 310 or the like in the protective mask 300.

Then, the performance evaluation of the above-described filter 310 was implemented as a utilization example of the radioactive fine particle manufacturing system 1 of the present invention. FIG. 12 shows a utilization example of the radioactive fine particle manufacturing system 1 to implement performance evaluation of the filter 310 or the like in the protective mask 300. In FIG. 12, parts with the same reference signs as those in FIG. 1 denote the same elements, and hence a description thereof will be omitted. As shown in FIG. 12, 2 filters (filter papers) 310 are aligned in series and disposed in a pipe Pe running from a joint 32*c* of a mixing chamber 30 to an exposure tank 40. Each of the filters 310 in the pipe Pe can externally be removed from the pipe Pe. In this state, a fine particle having a specific particle size of a traceable radioactivity concentration (concentration Ca) in the mixing chamber 30 is fed to the pipe Pe. Then, as shown in FIG. 12, fine particles having a specific particle size Ra, Rm or the like of the concentration Ca proceed in the direction of arrow A1 to be collected by the first filter 310, and after passing through the first filter 310, the particles are converted into fine particles Ri, Rk or the like having a specific particle size of a concentration Cb. Subsequently, as shown in FIG. 12, fine particles having a specific particle size Ri, Rk or the like of the concentration Cb proceed in the direction of arrow A2 to be collected by the second filter 310. Thereafter, as in Embodiment 3, the first and second filters 310 are externally removed from the pipe Pe to measure the filter by a radiation meter equipped in the laboratory. Assuming that the radiation meter is already calibrated, the radioactivity concentration Ca of the first filter 310 and the radioactivity concentration Cb of the second filter 310 can be obtained. The comparison of the radioactivity concentration Ca of the traceable first filter 310 and the radioactivity concentration Cb of the second filter 310 can evaluate the collection efficiency of the filter 310 relative to a fine particle having a specific particle size. The fine particle having a specific particle size Rk of the concentration Cc passing through the second filter 310 proceeds in the direction of arrow A3 (in the exposure chamber 40) to be collected by the filters in the exposure chamber 40. As in Embodiment 3, the filter can externally be removed from the exposure chamber 40 to measure the filter by the radiation meter placed in the laboratory.

As described above, according to Embodiment 6 of the present invention, as a utilization example, the radioactive fine particle manufacturing system 1 of the present invention can be used for performance evaluation of a protective mask 300 in the field of labor health. Specifically, 2 filters (filter papers) 310 are aligned in series and disposed in a pipe Pe running from a joint 32*c* of a mixing chamber 30 to an exposure tank 40. In this state, a fine particle having a specific particle size of a traceable radioactivity concentration (concentration Ca) in the mixing chamber 30 is fed to the pipe Pe. The first and second filters 310 are externally removed from the pipe Pe to measure the filter by a radiation meter placed in the laboratory. The comparison of the radioactivity concentration Ca of the traceable first filter 310 and the radioactivity concentration Cb of the second filter 310 can evaluate the collection efficiency of the filter 310 relative to a fine particle having a specific particle size.

Embodiment 7

Figure 13:
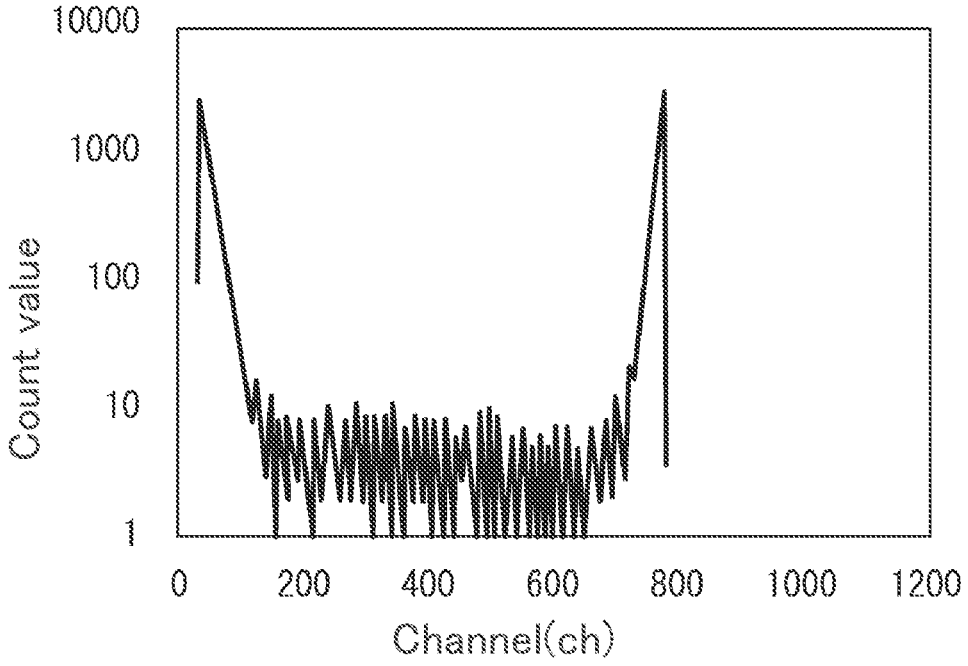
FIG. 13 shows a graph indicative of the measurement results of a filter used in the radioactive dust monitor measured by a radiation meter.

As a utilization example of the present invention, it can be used for precise performance evaluation of a radioactive dust monitor and filters (filter papers) used in the monitor placed in nuclear power plants or medical institutions such as hospitals. The above filters may be used as a filter in an exposure chamber 40 as in Embodiment 3, and measured by a radiation meter placed in the laboratory. FIG. 13 shows a graph indicative of the measurement results of a filter used in the radioactive dust monitor measured by a radiation meter. In FIG. 13, the horizontal line shows the channel (ch) and the vertical line shows the count value. As shown in FIG. 13, it was found that the radiation having a specific channel width (approx. 100 to 700) is counted.

As described above, according to Embodiment 7 of the present invention, as a utilization example, the radioactive fine particle manufacturing system 1 of the present invention can be used for performance evaluation of a filter of a monitoring device in the field of radiation management.

Embodiment 8

Figure 14:
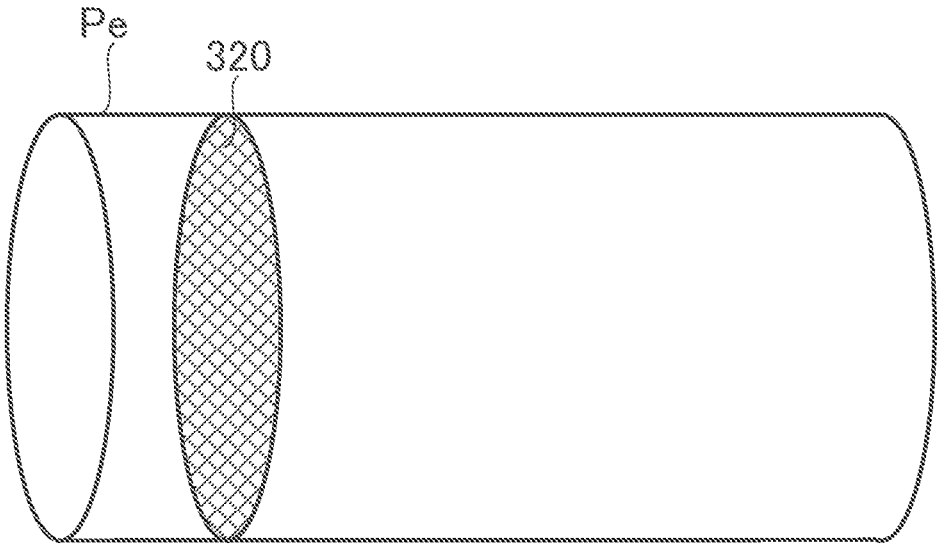
FIG. 14 shows a conceptual diagram indicative of collecting a radioactive fine particle acquired into nasal passages by inspiration.

As a utilization example of the present invention, it can be used for the research of inhalation exposure mechanism of radioactive fine particles in the human body in the field of environmental toxicology. A radioactive fine particle in the atmosphere is acquired in nasal passages by inspiration, and further in the bronchial region. It is possible to contribute to providing clearer understanding of internal exposure (deposition of radioactive fine particles in respiratory airways) by intake in inhalation in the human body by using the radioactive fine particle manufacturing system 1 of the present invention. FIG. 14 shows a conceptual diagram indicative of collecting a radioactive fine particle acquired into nasal passages by inspiration. As in Embodiment 6, a filter (filter paper) 320 is disposed in a pipe Pe running from a joint 32*c* of a mixing chamber 30 of a radioactive fine particle manufacturing system 1 to an exposure tank 40. The filter 320 is a metal wire screen of about 100-mesh (predetermined size), and a sampler showing simulated nasal passages. As in Embodiments 3 and 6, a fine particle having a specific particle size of a traceable radioactivity concentration (concentration Ca) in the mixing chamber 30 is fed to the pipe Pe. Thereafter, the filter 320 is removed from the pipe Pe, the filter of the exposure chamber 40 is externally removed to measure both of the filters by a radiation meter placed in the laboratory. The comparison of the traceable radioactivity concentration Ca (radioactivity concentration of filter 320) and the radioactivity concentration of the filter of the exposure chamber 40 can obtain the amount of collection by the filter 320 relative to a fine particle having a specific particle size, that is, the amount of radioactive fine particles deposited in nasal passages (amount of internal exposure).

Figure 15:
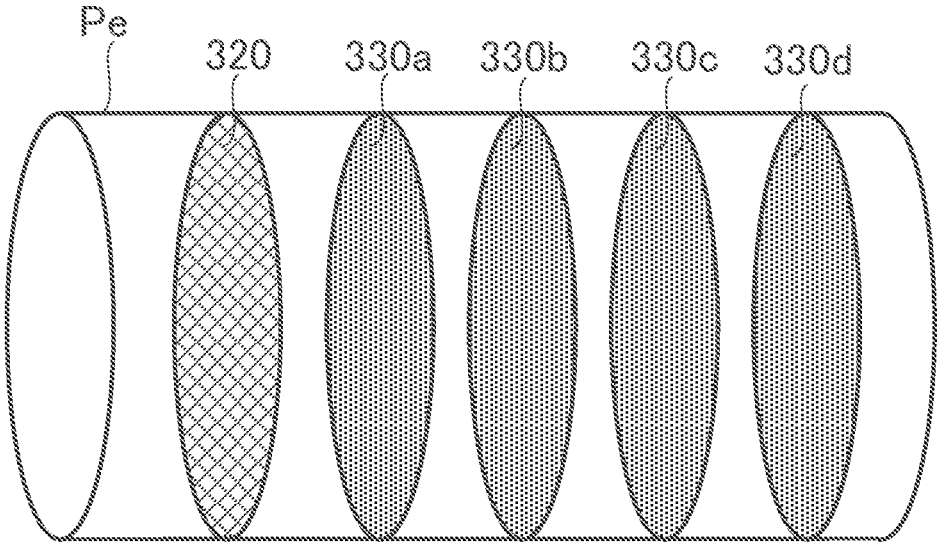
FIG. 15 shows a conceptual diagram indicative of collecting a radioactive fine particle acquired in nasal passages and bronchial region by inspiration.

FIG. 15 shows a conceptual diagram indicative of collecting a radioactive fine particle acquired in nasal passages and bronchial region by inspiration. As in the above-described nasal passages, a filter (filter paper) 320 and a plurality of filters 330*a* to 330*d* having different mesh from the filter 320 are disposed in a pipe Pe running from a joint 32*c* of a mixing chamber 30 of a radioactive fine particle manufacturing system 1 to an exposure tank 40. The filters 330*a* to 330*d* are each a metal wire screen of about 400-mesh (predetermined-size), and a sampler showing a simulated bronchial region. As in the above-described nasal passages, a fine particle having a specific particle size of a traceable radioactivity concentration (concentration Ca) in the mixing chamber 30 is fed to the pipe Pe. Thereafter, the filter 320 and the filters 330*a* to 330*d* are removed from the pipe Pe, and the filter of the exposure chamber 40 is externally removed to measure all the filters 320 or the like by a radiation meter placed in the laboratory. The comparison of the traceable radioactivity concentration Ca (radioactivity concentration of filter 320), the radioactivity concentration of each of the filters 330*a* to 330*d*, and the radioactivity concentration of the filters of the exposure chamber 40 can obtain the amount of collection by the filter 320 relative to a fine particle having a specific particle size (or amount of radioactive fine particles deposited in nasal passages (amount of internal exposure)), the amount of collection by the filters 330*a* to 330*d* (or amount of radioactive fine particles deposited in the bronchial region (amount of internal exposure)).

As described above, according to Embodiment 8 of the present invention, as a utilization example, the radioactive fine particle manufacturing system 1 of the present invention can be used for the research of inhalation exposure mechanism of radioactive fine particles in the human body in the field of environmental toxicology. Specifically, a filter (filter paper) 320 (metal wire screen of about 100-mesh) as a sampler showing simulated nasal passages is disposed in a pipe Pe running from a joint 32*c* of a mixing chamber 30 of a radioactive fine particle manufacturing system 1 to an exposure tank 40. In addition to the filter 320, filters 330*a* to 330*d* (each metal wire screen of about 400-mesh) as a sampler showing a simulated bronchial region can be disposed. As in Embodiments 3 and 6, a fine particle having a specific particle size of a traceable radioactivity concentration (concentration Ca) in the mixing chamber 30 is fed to the pipe Pe. Thereafter, the filters 320, 330*a* to 330*d* are removed from the pipe Pe, and the filters of the exposure chamber 40 are externally removed to measure each of the filters by a radiation meter placed in the laboratory. The comparison of the radioactivity concentrations of the filters 320 or the like can obtain the amount of collection by each of the filters 320 or the like relative to a fine particle having a specific particle size (amount of radioactive fine particles deposited in nasal passages or the bronchial region (amount of internal exposure)).

INDUSTRIAL APPLICABILITY

As a utilization example, the present invention can be used for precise performance evaluation of air dust catching filter papers, dust masks and others, calibration of a radioactive dust monitor placed in nuclear power plants or medical institutions such as hospitals and filters (filter papers) used in the monitor, and clearer understanding of internal exposure by intake in inhalation (deposition of fine particles in respiratory airways).

EXPLANATIONS OF LETTERS OR NUMERALS

1 a radioactive fine particle manufacturing system, 5 a radioactive fine particle manufacturing system (in the narrow sense), 10 a radioactive gas generating system, 11 a filter-holder, 12 a radiation source unit, 13 a natural radiation source, 20 a specific particle-sized aerosol generating system, 21 an aerosol generator, 22,72,111*a*,111*b*,111*c*,111*d*, 111*e*,111*f* a diffusion dryer, 23 an electrostatic classifier, 30 a mixing chamber, 31,41*a*,41*b*,41*c*,41*d* a fan, 32*a*,32*b*,32*c*, 32*d*,32*e*,32*f* a joint, 40 an exposure chamber, 50 an environmental monitor, 51 a thermometer, 52 a relative humidity meter, 60 a radioactive gas monitor portion, 61 a radioactive gas monitor, 70 a dry air intake, 71 a monocular sieve filter device, 80 a pressure adjusting portion, 90 a scanning mobility particle sizer, 100 a humidity control unit, 110 a drying portion, 105,125 a relative humidity monitor, 120 a humidity regulator, 121*a*,121*c*,121*c* a washing bottle, 121*a*IN,121*a*OUT a pipe, 200 passive thoron progeny nuclide monitor, 210 a polypropylene, 220 an aluminum film, 230 a stainless plate, 240 CR-39 (registered trademark), 300 a protective mask, 310, 320, 330*a*, 330*b*, 330*c*, 330*d* a filter.

Leg a legend, Pm a pump, If an inline-filter-folder, P1,P2,Pe a pipe, OA open air, AI an acquired air, EAO an exhausting, EX an exhaust, R1,R2,Ra,Ri,Rk,Rm a radioactive fine particle, RA, RA' an area where a radioactive fine particle R1 or the like is present, Ca, Cb, Cc a radioactivity concentration.

The invention claimed is:

1. A radioactive fine particle manufacturing system, comprising:

a radioactive gas generating apparatus for generating a natural radioactive noble gas, a fine particle generating apparatus for generating a non-radioactive fine particle, a mixing chamber for mixing the natural radioactive noble gas generated by the radioactive gas generating apparatus and the non-radioactive fine particle generated by the fine particle generating apparatus; and an enclosed exposure chamber connected to said mixing chamber for receiving a radioactive fine particle having a predetermined particle size generated in said mixing chamber in a one-way direction, wherein said radioactive gas generating apparatus includes a radiation source unit that has a natural radiation source therein, whereby the apparatus feeds externally acquired air to the radiation source unit, mixes the air and the natural radioactive noble gas generated from the natural radiation source, and feeds the same to said mixing chamber, said fine particle generating apparatus includes a fine particle generator for generating a fine particle and a particle discriminator for discriminating a fine particle having a uniform and predetermined particle size, whereby the apparatus discriminates a non-radioactive fine particle having the uniform and predetermined particle size from the non-radioactive fine particle generated by the fine particle generator by using the particle discriminator and feeds the non-radioactive fine particle having the uniform and predetermined particle size to said mixing chamber, and said mixing chamber attaches a progeny nuclide converted by radioactive decay from the natural radioactive gas fed from said radioactive noble gas generating apparatus to the non-radioactive fine particle having the uniform and predetermined particle size fed from said fine particle generating apparatus to generate a radioactive fine particle having the uniform and predetermined particle size.

2. The radioactive fine particle manufacturing system according to claim 1, wherein said radioactive gas generating apparatus further comprises a humidity control unit for feeding acquired air by controlling the humidity thereof, whereby the apparatus controls the radioactivity concentration of a natural radioactive noble gas generated from said natural radiation source by feeding externally acquired air to said radiation source unit after allowing the air to pass through the humidity control unit.

3. The radioactive fine particle manufacturing system according to claim 1, wherein said mixing chamber further comprises a pipe for feeding a generated radioactive fine particle having a predetermined particle size to the exposure chamber, wherein the pipe includes therein one or more externally removable filters for collecting the radioactive fine particle having a predetermined particle size.

4. The radioactive fine particle manufacturing system according to claim 3, wherein said one or more externally removable filters are each a metal wire screen composed of a predetermined-size mesh.

5. The radioactive fine particle manufacturing system according to claim 1, wherein said exposure chamber includes an externally removable filter for collecting a fed radioactive fine particle having a predetermined particle size.

6. The radioactive fine particle manufacturing system according to claim 1, wherein said natural radiation source is $^{220}$Rn or $^{222}$Rn generated from an environmental sample.

7. The radioactive fine particle manufacturing system according to claim 1, wherein said particle discriminator is a differential mobility analyzer.

8. A radioactive fine particle manufacturing method by employing a radioactive gas generating apparatus for generating a natural radioactive noble gas, a fine particle generating apparatus for generating a non-radioactive fine particle, and a mixing chamber for mixing the natural radioactive noble gas generated by the radioactive gas generating apparatus and the non-radioactive fine particle generated by the fine particle generating apparatus, the method comprising the steps of:

a generating a natural radioactive noble gas step of, in said radioactive gas generating apparatus, feeding externally acquired air to the radiation source unit including a natural radiation source therein, generating a natural radioactive noble gas from the air and the natural radiation source, and feeding the same to the mixing chamber;

a generating a non-radioactive fine particle step of, in said fine particle generating apparatus, generating a non-radioactive fine particle by a fine particle generator for generating a fine particle, discriminating a non-radioactive fine particle having a uniform and predetermined particle size from the non-radioactive fine particle by using a particle discriminator for discriminating a fine particle having the uniform and predetermined particle size, and feeding the same to said mixing chamber;

a generating a radioactive fine particle step of, in said mixing chamber, attaching a progeny nuclide converted by radioactive decay from the natural radioactive noble gas fed from said radioactive gas generating apparatus in said step of generating a natural radioactive noble gas to the non-radioactive fine particle having the uniform and predetermined particle size fed from said fine particle generating apparatus in said step of generating a non-radioactive fine particle to generate a radioactive fine particle having the uniform and predetermined particle size; and a step of collecting a radioactive fine particle by outputting a radioactive fine particle having the uniform and predetermined particle size and generated in said step of generating a radioactive fine particle, from said mixing chamber in a one-way direction to an enclosed exposure chamber connected to said mixing chamber.

9. The radioactive fine particle manufacturing method according to claim 8, wherein said radioactive gas generating apparatus further comprises a humidity control unit for feeding acquired air by controlling the humidity thereof, whereby said step of generating a natural radioactive noble gas controls the radioactivity concentration of said natural radioactive noble gas generated by feeding externally acquired air to said radiation source unit after allowing the air to pass through said humidity control unit.

10. The radioactive fine particle manufacturing method according to claim 8, wherein the method further comprises a step of collecting the radioactive fine particle by an externally removable filter included in said exposure chamber.

11. The radioactive fine particle manufacturing method according to claim 8, wherein said natural radiation source is $^{220}Rn$ or $^{222}Rn$ generated from an environmental sample.

12. The radioactive fine particle manufacturing method according to claim 8, wherein said particle discriminator is a differential mobility analyzer.

* * * * *